US010396421B2

(12) United States Patent
Zhang et al.

(10) Patent No.: US 10,396,421 B2
(45) Date of Patent: Aug. 27, 2019

(54) SLOT COUPLED DIRECTIONAL COUPLER AND DIRECTIONAL FILTERS IN MULTILAYER SUBSTRATE

(71) Applicants: Yifei Zhang, Jinan (CN); Shouyuan Shi, Newark, DE (US); Richard Martin, Newark, DE (US); Dennis Prather, Newark, DE (US)

(72) Inventors: Yifei Zhang, Jinan (CN); Shouyuan Shi, Newark, DE (US); Richard Martin, Newark, DE (US); Dennis Prather, Newark, DE (US)

( * ) Notice: Subject to any disclaimer, the term of this patent is extended or adjusted under 35 U.S.C. 154(b) by 79 days.

(21) Appl. No.: 15/666,637

(22) Filed: Aug. 2, 2017

(65) Prior Publication Data

US 2018/0233796 A1 Aug. 16, 2018

Related U.S. Application Data

(60) Provisional application No. 62/457,617, filed on Feb. 10, 2017.

(51) Int. Cl.

| | |
|---|---|
| ***H01P 5/18*** | (2006.01) |
| ***H01P 1/203*** | (2006.01) |
| ***H01P 1/212*** | (2006.01) |

(52) U.S. Cl.

CPC ..... *H01P 1/212* (2013.01); *H01P 5/184* (2013.01); *H01P 5/185* (2013.01); *H01P 5/187* (2013.01)

(58) Field of Classification Search

CPC ..... H01P 5/18; H01P 5/184

USPC ..... 333/109, 116

See application file for complete search history.

(56) References Cited

U.S. PATENT DOCUMENTS

| | | | | |
|---|---|---|---|---|
| 2,748,350 A | | 5/1956 | Miller | |
| 3,237,130 A | | 2/1966 | Cohn | |
| 3,575,674 A | * | 4/1971 | Howe, Jr. | H01P 5/187 333/116 |
| 3,581,243 A | | 5/1971 | Alford | |
| 4,216,446 A | | 8/1980 | Iwer | |
| 4,287,605 A | * | 9/1981 | Dydyk | H01P 1/2138 330/4.9 |
| 4,737,740 A | * | 4/1988 | Millican | H01P 5/187 333/116 |
| 4,999,593 A | | 3/1991 | Anderson | |
| 5,159,298 A | | 10/1992 | Dydyk | |
| 5,424,694 A | | 6/1995 | Maloratsky et al. | |
| 5,625,328 A | | 4/1997 | Coleman, Jr. | |
| 5,689,217 A | | 11/1997 | Gu et al. | |
| 6,771,141 B2 | | 8/2004 | Iida et al. | |
| 9,444,127 B2 | * | 9/2016 | Katabuchi | H01P 5/187 |

FOREIGN PATENT DOCUMENTS

| | | | |
|---|---|---|---|
| JP | 4-321302 | * | 11/1992 |

* cited by examiner

*Primary Examiner* — Dean O Takaoka

(74) *Attorney, Agent, or Firm* — Muir Patent Law PLLC

(57) ABSTRACT

Traveling-wave directional filters (DFs) with multiple coupling slots are disclosed. A traveling-wave directional filter may include two terminating conductive strips in a top circuit layer of a substrate, a loop resonator in a bottom layer of a substrate, and a shared ground plane. Coupling slots in the ground plane may couple the conductive strips via the loop resonator.

31 Claims, 16 Drawing Sheets

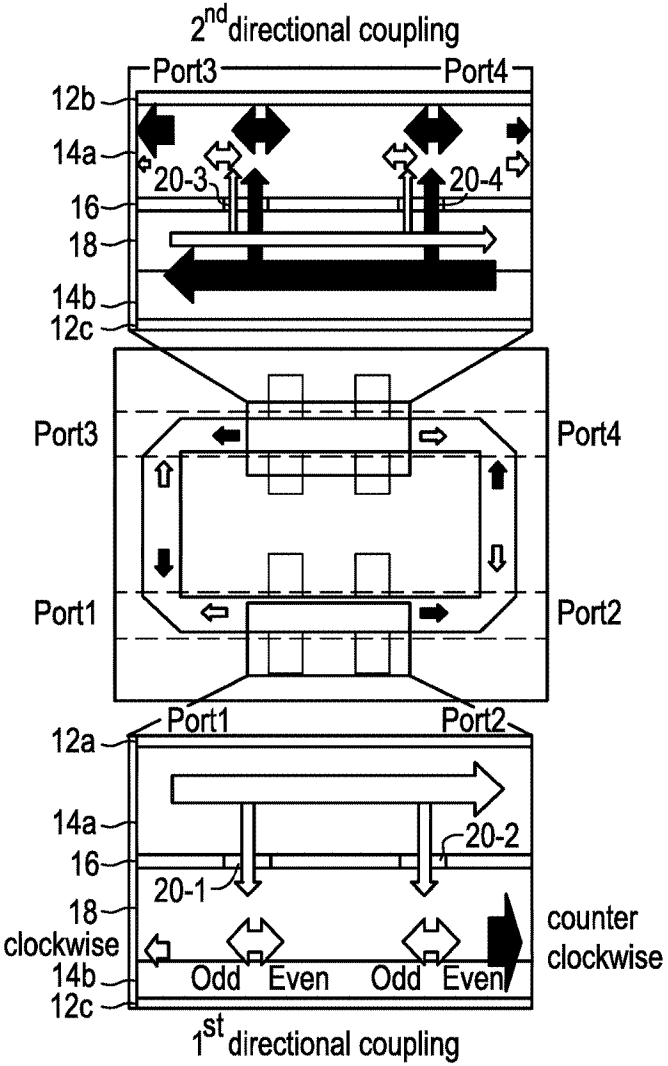
FIG. 4B
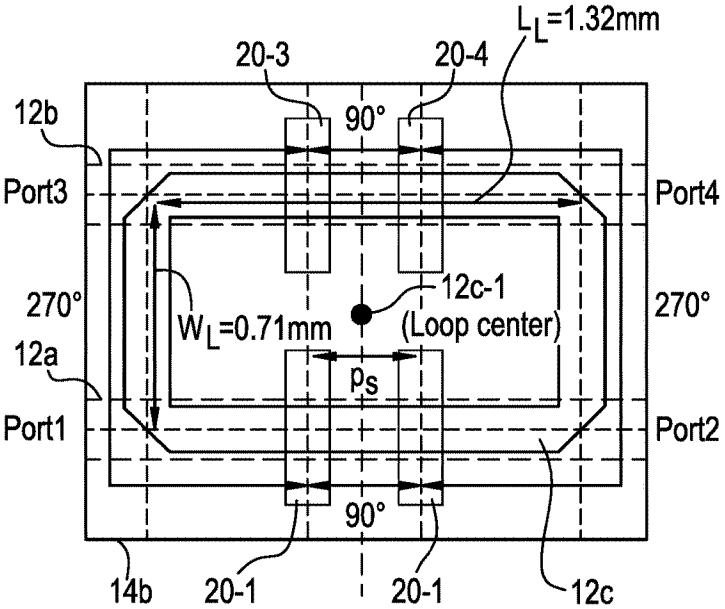

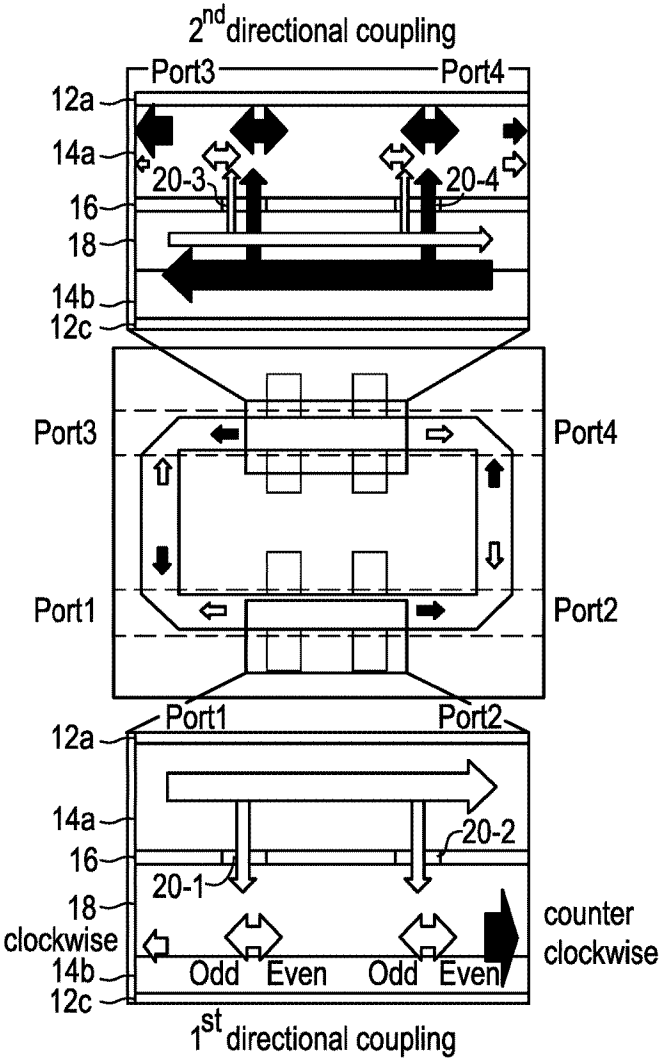
FIG. 4C
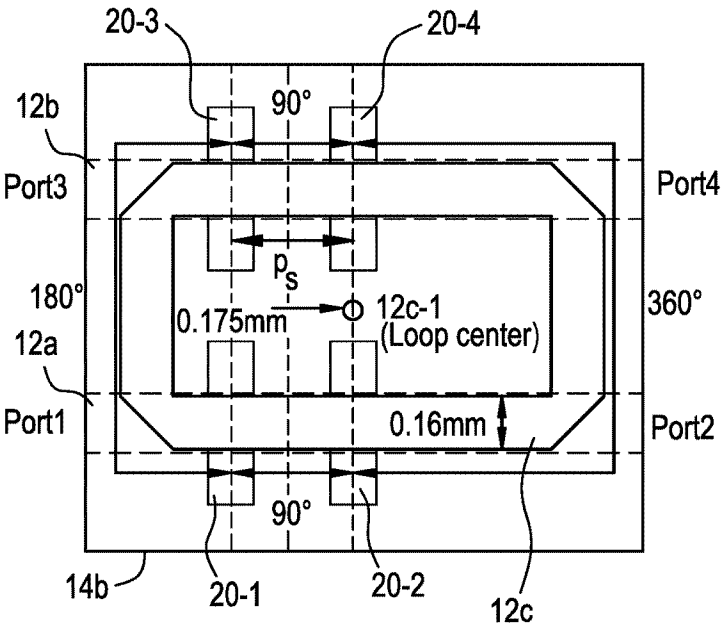

SLOT COUPLED DIRECTIONAL COUPLER AND DIRECTIONAL FILTERS IN MULTILAYER SUBSTRATE

CROSS-REFERENCE TO RELATED APPLICATIONS

This U.S. non-provisional patent application claims priority under 35 U.S.C. § 119 to U.S. provisional patent application No. 62/457,617, filed on Feb. 10, 2017, with the United States Patent and Trademark Office, the entire contents of which are hereby incorporated by reference.

BACKGROUND

Directional filters (DFs) have gained interest in the applications of frequency division multiplexing and system stability improvement at circuit level. They may act either as channel combiners or channel separators. DFs address miniaturization and low reflection requirements of various implementations. Various DFs have been devised; however, a limited number of them have found practical applications.

FIGS. 1(*a*), 1(*b*), 1(*c*) and 1(*d*) show various examples of prior art DFs. For example, a broadband signal fed into Port 1 of the DFs shown in FIGS. 1(*a*)-(*d*) will be isolated at Port 4 ("isolated" indicating the signal is substantially not sent to Port 4), the desired spectrum will be dropped to Port 3, and the signal at the undesired spectrum will travel to Port 2, with substantially no reflection back to Port 1. According to mechanism, DFs can be classified into three categories: waveguide-based DFs, standing-wave DFs, and traveling-wave DFs. A waveguide-based DF comprises two rectangular waveguides and one cylindrical directly-coupled cavity resonator, as shown in FIG. 1(*a*). Typically, it is bulky and heavy, and has a narrow bandwidth of less than 2%.

FIGS. 1(*b*) and 1(*c*) show two types of standing-wave DFs with essentially the same frequency response. Each of them has two standing-wave resonators between two terminating lines, and can provide several percent bandwidth. However, tiny coupling gaps between the resonators and terminating lines are critically desired to provide sufficient coupling, which is extremely challenging for the commercially available circuit printing technologies, particularly when fabricating the devices for applications at high frequencies.

A traveling-wave DF comprises one or several traveling-wave loop resonators and two terminating lines, as shown in FIG. 1(*d*). The resonators and terminating lines are coupled by means of quarter-wavelength directional couplers. Passband width on the order of several percent can be achieved by using multiple loops. However, the traveling-wave DFs suffer from the same fabrication tolerance problem as the standing-wave DFs as the frequency increases.

The DFs of FIGS. 1(*a*)-(*d*) are typically designed to operate at a frequency below 40 GHz. As the frequency increases to W-band, i.e., 75-110 GHz, it becomes increasingly critical to obtain sufficient coupling between resonators and terminating lines with planar structures, leading to significant insertion loss. To this end, multilayer directional couplers were introduced to construct DFs. In these structures, the resonators and terminating lines are overlapped vertically, which may enhance the coupling, but may introduce large reflection and insertion loss. Insertion losses of the multilayer DFs may be as high as 5 dB at 6 GHz, 4 dB at 6 GHz, and 2.9 dB at 38 GHz. The coupling efficiency of the traditional multilayer quarter-wavelength directional coupler is strongly limited by the thickness of the substrates.

Thus, it is challenging to scale these multilayer DFs to higher frequencies due to the limited available thickness of the circuit substrate.

SUMMARY

Exemplary embodiments of the disclosure provide directional filters and directional couplers which are configured to reduce reflection loss and/or noise and increase directivity of the signals.

According to exemplary embodiments of the disclosure, a directional filter includes a first conductor line extending in a first direction, the first conductor line comprising a first end and a second end, a second conductor line spaced apart from the first conductor line, the second conductor line extending parallel to the first conductor line, the second conductor line comprising a third end and a fourth end, a conductor plate comprising a first hole, a second hole, a third hole and a fourth hole spaced apart from one another, and a first conductor loop disposed opposite the first and second conductor lines with respect to the conductor plate, wherein the first end is configured to be applied with an electro-magnetic signal, wherein the second end is configured to be transmitted with the electro-magnetic signal out of the operating spectrum, wherein the first conductor loop is configured to receive a first coupling signal of the electro-magnetic signal applied to the first end, and wherein the third end is configured to receive a second coupling signal of the first coupling signal. The fourth end may be configured to be isolated from the electro-magnetic signal applied to the first end. The second coupling signal received at the third end may have a first wavelength, and a circumferential distance of the first loop resonator may be an integer multiple of the first wavelength.

The directional filter may further include a first insulation layer formed between the first and second conductor lines and the conductor plate, the first insulation layer configured to insulate the first and second conductor lines from the conductor plate, and a second insulation layer formed between the first conductor loop and the conductor plate, the second insulation layer is configured to insulate the first conductor loop from the conductor plate. The first and second insulation layers may comprise a liquid crystal polymer. Other dielectric substrates may be used, such as printed circuit boards (PCB) made of a material with low loss at high frequencies.

The mean circumference of the first conductor loop may be two times of a wavelength of a microwave such as a millimeter wavelength having a frequency between 30 GHz and 300 GHz. Other frequencies may be implemented, such microwave frequencies between 1 GHz and 170 GHz or frequencies other than microwave and millimeter wave frequencies. The mean circumference of the first conductor loop may be about two times of a wavelength of a microwave or other EMF spectrums. The first and second holes may overlap with the first conductor line in a plan view, and the third and fourth holes overlap with the second conductor line in a plan view, wherein the first conductor loop may overlap with the first, second, third and fourth holes in a plan view, wherein the circumferential lengths of the first conductor loop on both sides, in a plan view, with respect to a line connecting a first center between the first and second holes and a second center between the third and fourth holes may be substantially the same.

The first and second holes may overlap with the first conductor line in a plan view, and the third and fourth holes overlap with the second conductor line in a plan view, wherein the first conductor loop may overlap with the first, second, third and fourth holes in a plan view, wherein the circumferential lengths of the first conductor loop on both sides, in a plan view, with respect to a line connecting the second hole and the fourth hole may be substantially the same.

The directional filter may further comprise a fifth hole, a sixth hole, a seventh hole and an eighth hole formed in the conductor plate, the fifth to eighth holes being spaced apart from one another; and a second conductor loop disposed opposite the first and second conductor lines with respect to the conductor plate, the second conductor loop being spaced apart from the first conductor loop, wherein the fifth and sixth holes may overlap with the first conductor line in a plan view, and the seventh and eighth holes overlap with the second conductor line in a plan view, wherein the second conductor loop may overlap with the fifth, sixth, seventh and eighth holes in a plan view. The circumferential lengths of the second conductor loop on both sides, in a plan view, with respect to a line connecting the sixth hole and the eighth hole may be substantially the same.

According to an embodiment of the present disclosure, a directional filter includes a first microstrip comprising a first port and a second port, a second microstrip disposed adjacent to the first microstrip, the second microstrip comprising a third port and a fourth port, a ground plate configured to receive a ground signal, the ground plate comprising a first slot, a second slot, a third slot and a fourth slot, and a first loop resonator disposed adjacent to the ground plate, wherein the first port is configured to receive an electro-magnetic signal, wherein the second port is configured to transmit the electro-magnetic signal out of the operating spectrum, wherein the first loop resonator is configured to receive a first coupling signal of the electro-magnetic signal applied to the first port, wherein the third port is configured to receive a second coupling signal of the first coupling signal.

The directional filter may further include a first insulation layer formed on the ground plate, and a second insulation layer formed between the first loop resonator and the ground plate, the second insulation layer is configured to insulate the first loop resonator from the ground plate. The first and second insulation layers may include a liquid crystal polymer. The fourth port may be configured to be isolated from the electro-magnetic signal applied to the first port. The mean circumference of the first loop resonator may be two times of a wavelength of a microwave having a frequency between 30 GHz and 300 GHz. The second coupling signal received at the third port may have a first wavelength, and a circumferential distance of the first loop resonator may be an integer multiple of the first wavelength.

The mean circumference of the first loop resonator may be about two times of a wavelength of a microwave having 95 GHz frequency. The first and second slots may overlap with a first conductive strip of the first microstrip in a plan view, and the third and fourth slots overlap with a second conductive strip of the second microstrip in a plan view, wherein the first loop resonator may overlap with the first, second, third and fourth slots in a plan view, wherein the circumferential lengths of the first loop resonator on both sides, in a plan view, with respect to a line connecting a first center between the first and second slots and a second center between the third and fourth slots may be substantially the same. The first and second slots may overlap with the first conductive strip in a plan view, and the third and fourth slots overlap with the second conductive strip in a plan view, wherein the first loop resonator may overlap with the first, second, third and fourth slots in a plan view, wherein the circumferential lengths of the first loop resonator on both sides, in a plan view, with respect to a line connecting the second slot and the fourth slot may be substantially the same.

The directional filter may further include a fifth slot, a sixth slot, a seventh slot and an eighth slot formed in the ground plate, and a second loop resonator disposed opposite adjacent to the ground plate, wherein the fifth and sixth slots may overlap with the first conductive strip in a plan view, and the seventh and eighth slots overlap with the second conductive strip in a plan view, wherein the second loop resonator may overlap with the fifth, sixth, seventh and eighth slots in a plan view. The mean circumference of the second loop resonator on both sides, in a plan view, with respect to a line connecting the sixth slot and the eighth slot may be substantially the same.

According to an embodiment of the present disclosure, a directional coupler includes a first conductor line extending in a first direction, the first conductor line comprising a first end and a second end, a second conductor line spaced vertically apart from the first conductor line, the second conductor line extending parallel to the first conductor line, the second conductor line comprising a third end and a fourth end, and a conductor plate comprising a first hole and a second hole spaced apart from each other, the conductor plate disposed between the first conductor line and the second conductor line, wherein the first end is configured to be applied with an electro-magnetic signal, wherein the second end is configured to be transmitted with the electro-magnetic signal, and wherein the fourth end is configured to receive a first coupling signal of the electro-magnetic signal applied to the first end.

The directional coupler may further include a first insulation layer formed between the first conductor line and the conductor plate, the first insulation layer configured to insulate the first conductor line from the conductor plate, and a second insulation layer formed between the second conductor line and the conductor plate, the second insulation layer is configured to insulate the second conductor line from the conductor plate. The first and second insulation layers may comprise a liquid crystal polymer. The third end may be configured to be isolated from the electro-magnetic signal applied to the first end.

The distance between the first hole and the second hole may be a quarter of a wavelength of a microwave having a frequency between 30 GHz and 300 GHz. The distance between the first hole and the second hole may be about a quarter of a wavelength of a microwave having 95 GHz frequency. The first and second holes may overlap with the first and second conductor lines in a plan view. The conductor plate may be a ground plate applied with a ground signal, wherein the first and second holes may penetrate through the ground plate, and wherein the first and second holes may be filled with insulation material. The first coupling signal received at the fourth end may have a wavelength of four times of a distance between the first hole and the second hole.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

FIG. 2(*b*) illustrates electric fields along the propagation direction of guided wave of the coupler illustrated in FIG. 2(*a*).

FIGS. 2(*c*) and 2(*d*) illustrate simulated S-parameters of the slot-coupled microstrips with different LCP thickness and different slot sizes, respectively.

FIG. 3(*b*) illustrates a cross-sectional view of the directional coupler of FIG. 3(*a*) according to an embodiment of the present disclosure.

FIG. 3(*c*) illustrates simulated $S_{11}$ and $S_{31}$ of the directional coupler of FIG. 3(*a*) in all LCP substrates and hybrid substrates according to an embodiment of the present disclosure.

FIG. 3(*d*) illustrates simulated $S_{21}$ and $S_{41}$ of the directional coupler of FIG. 3(*a*) in all LCP substrates and hybrid substrates according to an embodiment of the present disclosure.

FIG. 4(*b*) illustrates a bottom up view of the directional filter of FIG. 4(*a*) with symmetric loop topology according to an embodiment of the present disclosure.

FIG. 4(*c*) illustrates a bottom up view of the directional filter of FIG. 4(*a*) with asymmetric loop topology according to an embodiment of the present disclosure.

FIG. 4(*d*) illustrates simulated S-parameters of a single loop directional filter illustrated in FIGS. 4(*a*) and 4(*b*) with $p_s$=0.35 mm according to an embodiment of the present disclosure.

FIG. 4(*e*) illustrates simulated S-parameters of a single loop directional filter illustrated in FIGS. 4(*a*) and 4(*c*) with $p_s$=0.35 mm according to an embodiment of the present disclosure.

FIG. 4(*f*) illustrates a bottom up view of the directional filter of FIG. 4(*a*) with asymmetric multiple-wavelength loop topology according to an embodiment of the present disclosure FIG. 5(*a*) illustrates simulated and measured effective permittivity of the top and bottom conductive strips in a DF according to an embodiment of the present disclosure.

FIG. 6(*c*) illustrates simulated S-parameters of the DF of FIGS. 6(*a*) and 6(*b*) at $P_d$=1.9 mm according to an embodiment of the present disclosure.

FIG. 6(*d*) illustrates simulated S-parameters of the DF of FIGS. 6(*a*) and 6(*b*) at $P_d$=2.3 mm according to an embodiment of the present disclosure.

DETAILED DESCRIPTION

Figure 1A:
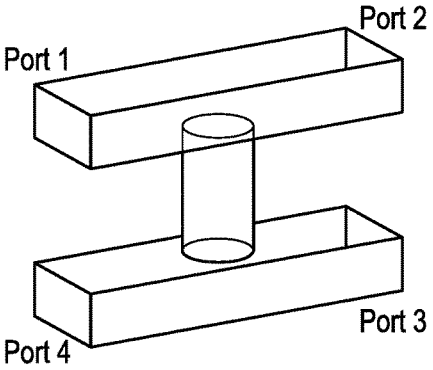
FIG. 1A PRIOR ART
FIGS. 1(*a*), 1(*b*), 1(*c*) and 1(*d*) show various examples of prior art directional filters.
Figure 1B:
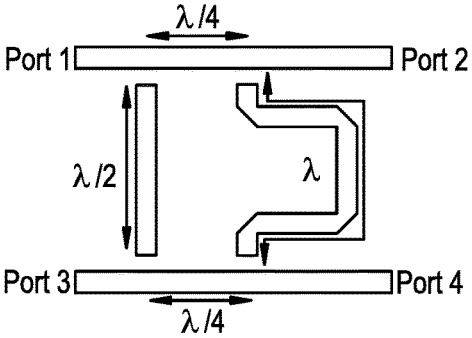
FIG. 1B PRIOR ART
Figure 1C:
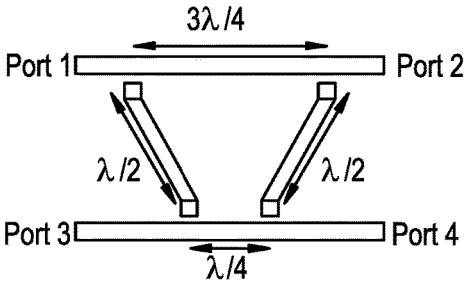
FIG. 1C PRIOR ART
Figure 1D:
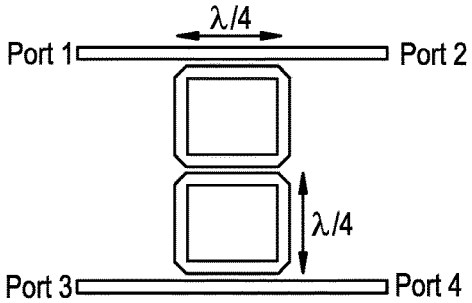
FIG. 1D PRIOR ART
Figure 2A:
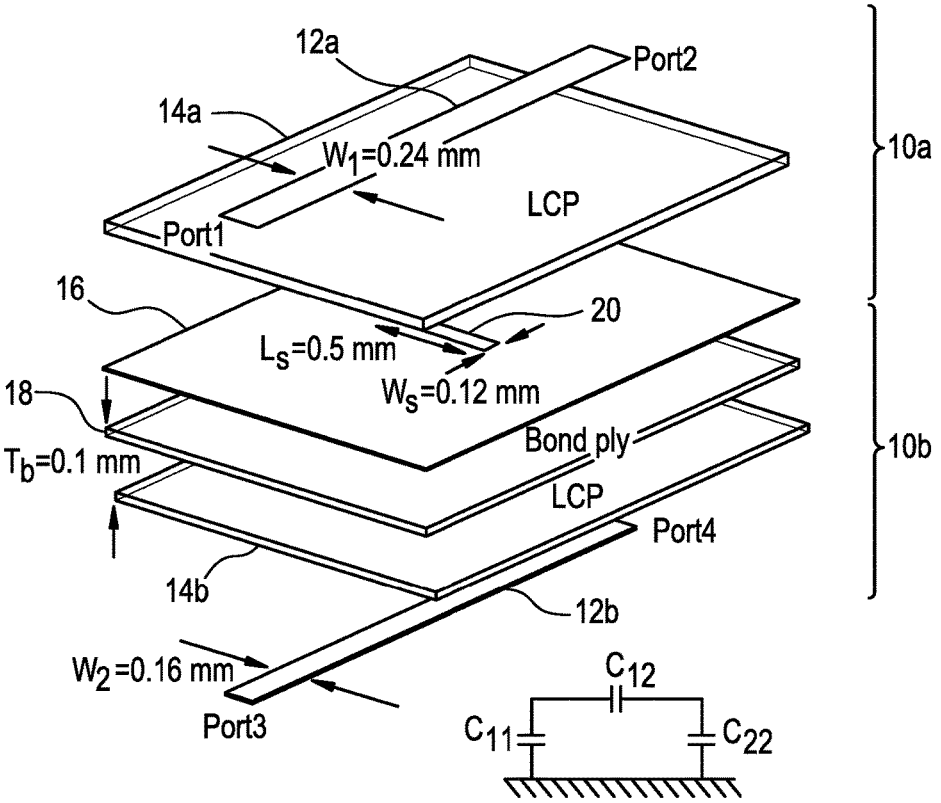
FIG. 2(*a*) illustrates a coupler including vertically overlapped microstrips with a coupled slot.
Figure 2B:
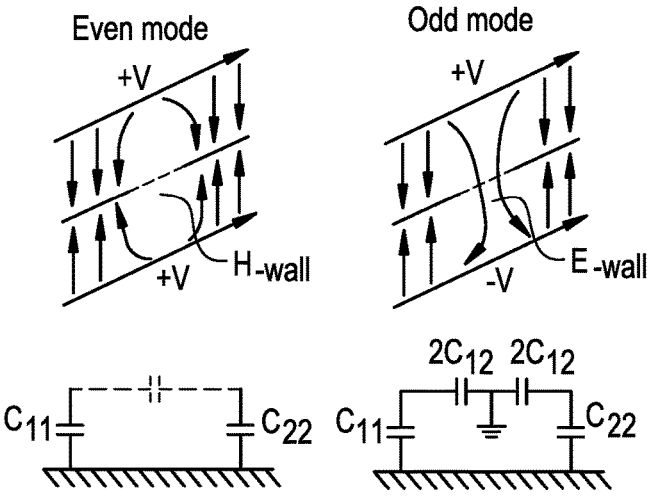
Figure 2D:
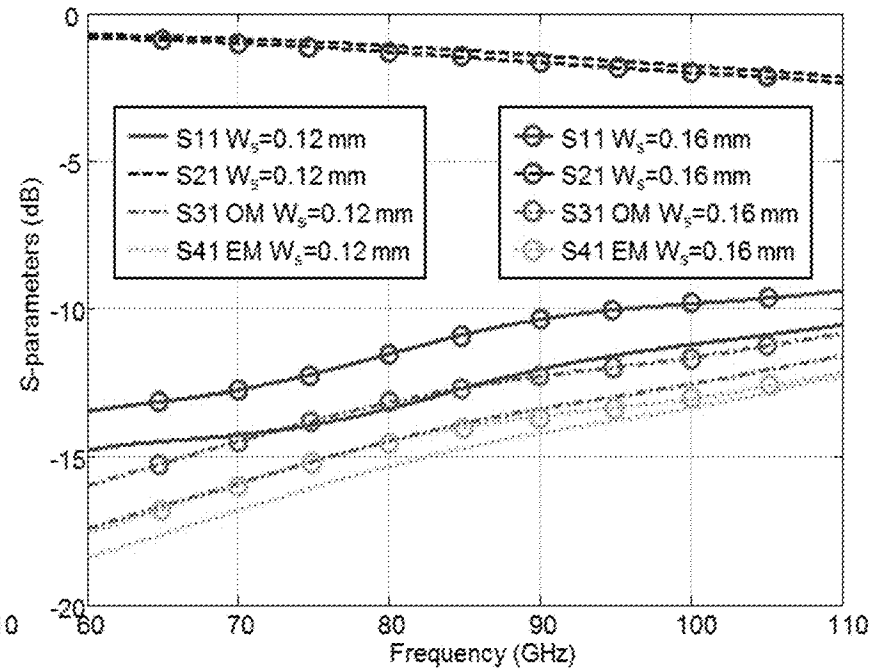
Figure 2C:
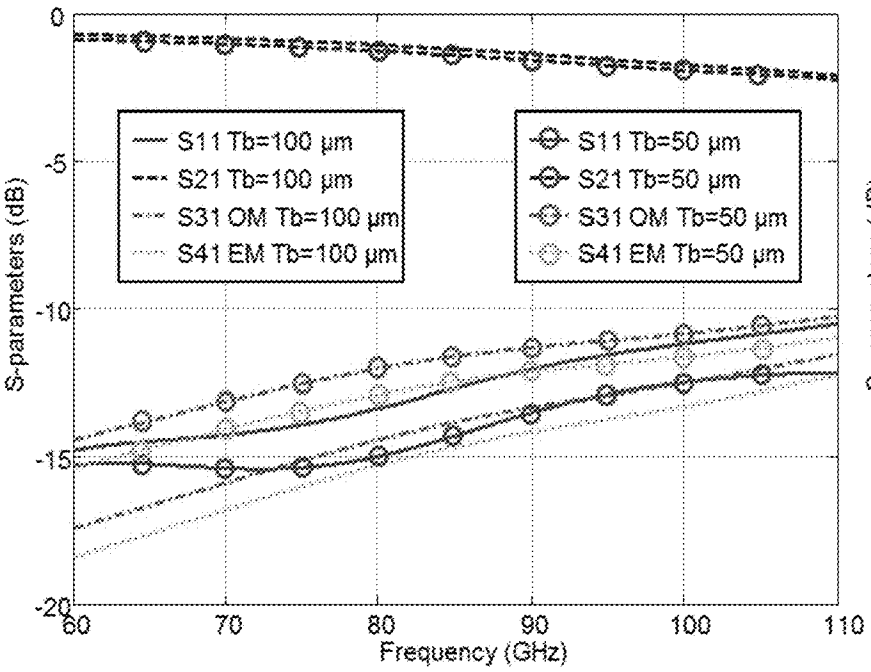
Figure 3B:
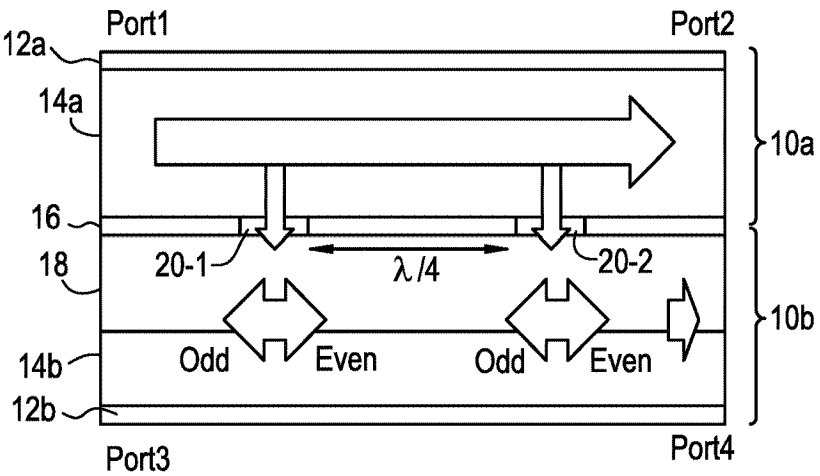
FIG. 3(*a*) illustrates a dual slot directional coupler with vertically overlapped microstrips according to an embodiment of the present disclosure.
Figure 3A:
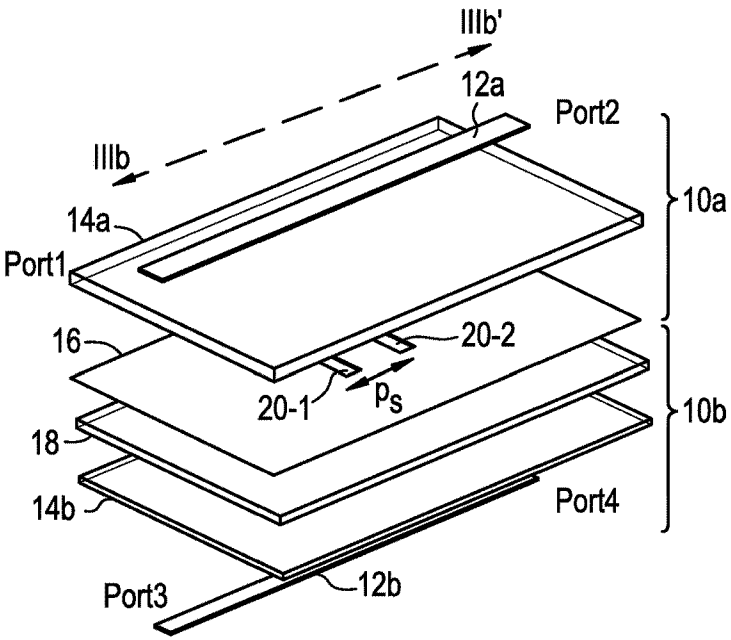
Figure 3D:
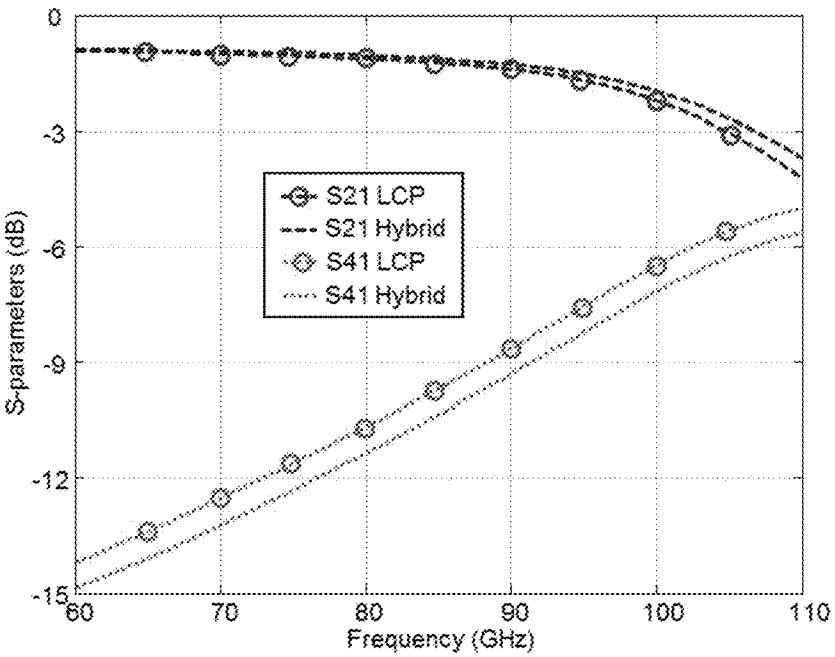
Figure 3C:
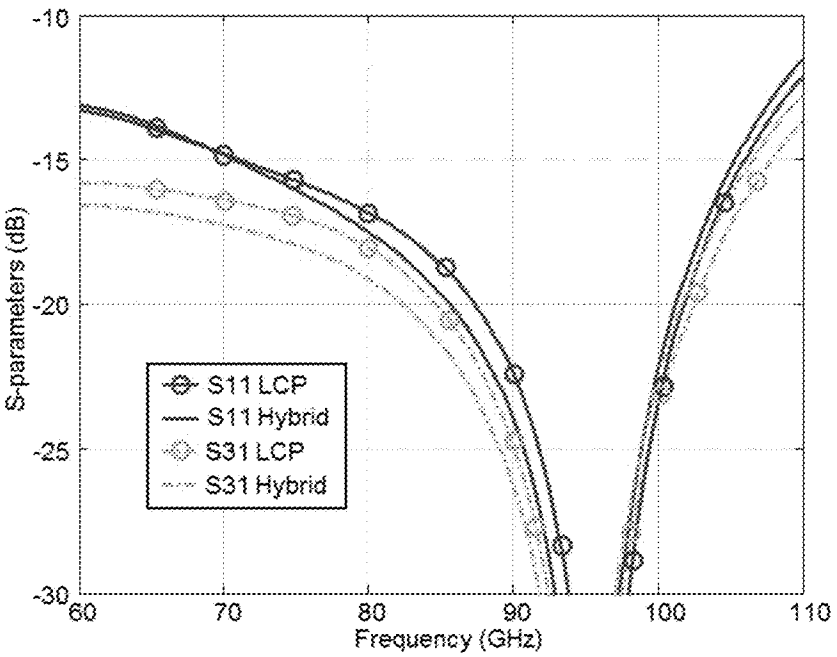
Figure 4A:
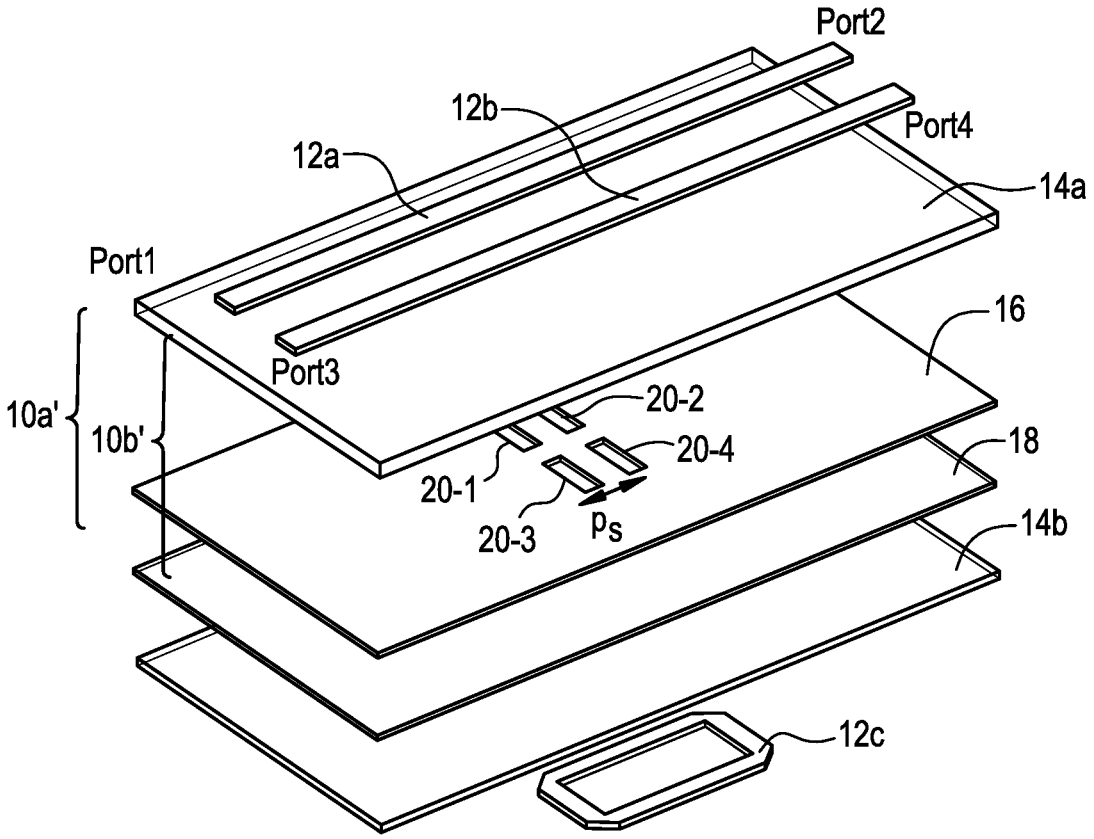
FIG. 4(*a*) illustrates a directional filter including four slots (or two directional couplers) and a loop resonator according to an embodiment of the present disclosure.
Figure 4E:
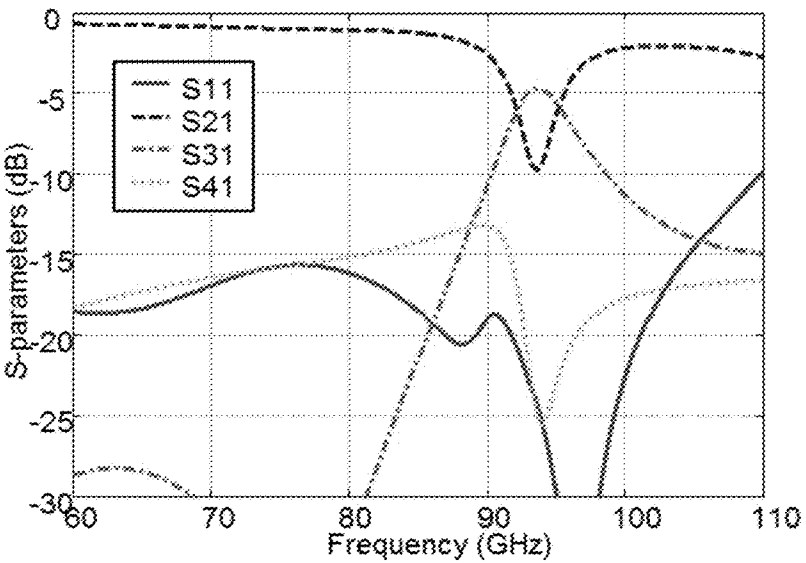
Figure 4D:
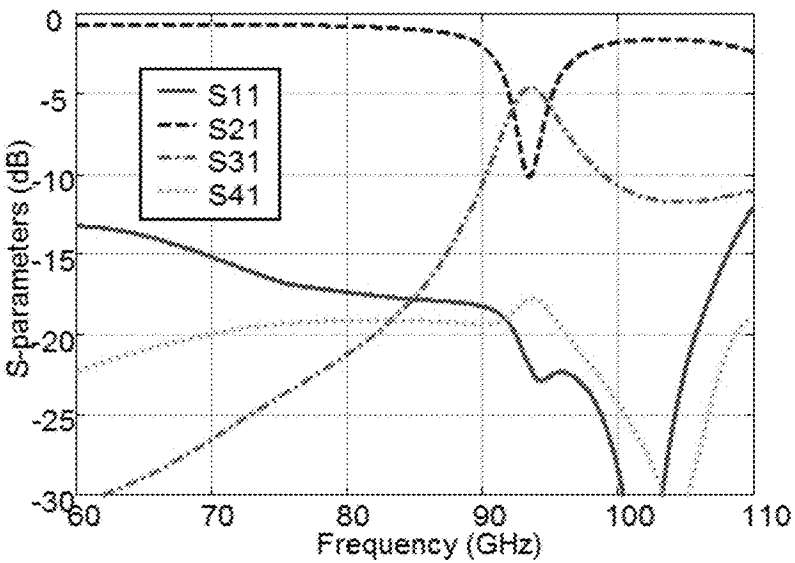
Figure 4F:
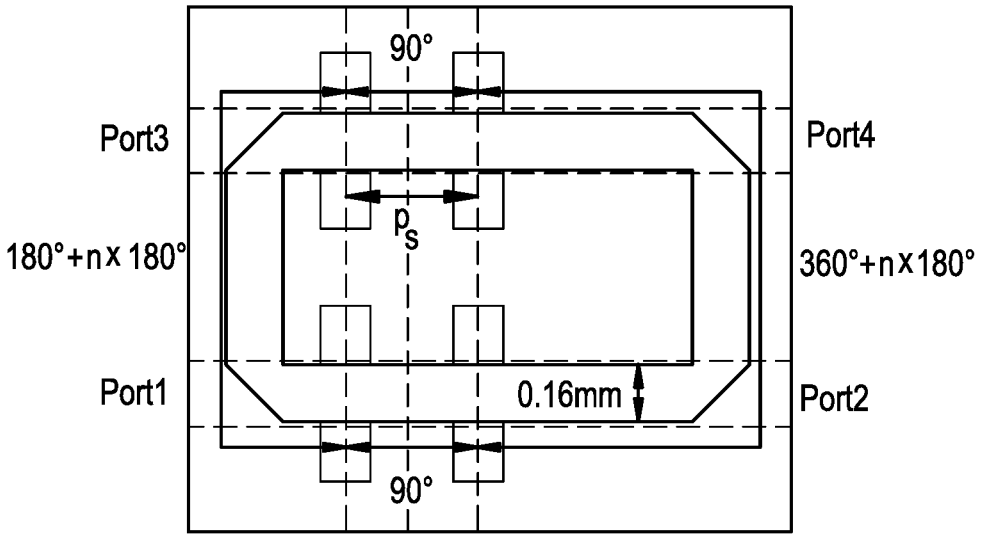

The present disclosure now will be described more fully hereinafter with reference to the accompanying drawings, in which various embodiments are shown. The invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

It will be appreciated that the use of the same or similar reference numerals indicates the same or similar structure and thus associated description is typically relevant to all such same/similar structure. Use of suffixes for reference numerals (e.g., "n" for reference numeral "100-*n*") is used when several similar structures are provided and/or variations are implemented. Generic use of a reference numeral without a suffix (e.g., just "100") may refer individually to all such structures (e.g., each of 100-1, 100-2 . . . 100-*n*).

In the drawings, different figures show various features of exemplary embodiments, these figures and their features are not necessarily intended to be mutually exclusive from each other. Rather, certain features depicted and described in a particular figure may also be implemented with embodiment (s) depicted in different figure(s), even if such a combination is not separately illustrated. Referencing such features/figures with different embodiment labels (e.g. "first embodiment") should not be interpreted as indicating certain features of one embodiment are mutually exclusive of and are not intended to be used with another embodiment.

Unless the context indicates otherwise, the terms first, second, third, etc., are used as labels to distinguish one element, component, region, layer or section from another element, component, region, layer or section (that may or may not be similar). Thus, a first element, component, region, layer or section discussed below in one section of the specification (or claim) may be referred to as a second element, component, region, layer or section in another section of the specification (or another claim).

It will be understood that when an element is referred to as being "connected," "coupled to" or "on" another element, it can be directly connected/coupled to/on the other element or intervening elements may be present. In contrast, when an element is referred to as being "directly connected" or "directly coupled" to another element, or as "contacting" or "in contact with" another element, there are no intervening elements present.

Spatially relative terms, such as "beneath," "below," "lower," "above," "upper" and the like, may be used herein for ease of description to describe one element's or feature's positional relationship relative to another element(s) or feature(s) as illustrated in the figures. It will be understood that such spatially relative terms are intended to encompass different orientations of the device in use or operation in addition to the orientation depicted in the figures. Thus, a device depicted and/or described herein to have element A below element B, is still deemed to have element A below element B no matter the orientation of the device in the real world.

Embodiments may be illustrated herein with idealized views (although relative sizes may be exaggerated for clarity). It will be appreciated that actual implementation may vary from these exemplary views depending on manufacturing technologies and/or tolerances. Therefore, descriptions of certain features using terms such as "same," "equal," and geometric descriptions such as "planar," "coplanar," "cylindrical," "square," etc., as used herein when referring to orientation, layout, location, shapes, sizes, amounts, or other measures, encompass acceptable variations from exact identicality, including nearly identical layout, location, shapes, sizes, amounts, or other measures within acceptable variations that may occur, for example, due to manufacturing processes. The term "substantially" may be used herein to emphasize this meaning, unless the context or other statements indicate otherwise.

Operational spectrum refers to a range of radio frequencies or other electromagnetic waves that the disclosed couplers and filters are designed to transmit as described herein. A center operational frequency of the operational spectrum may be a frequency within the operational spectrum that the disclosed couplers and filters (or components thereof) are designed to transmit in an optimal manner, recognizing that nearby frequencies to the center operational frequency may be transmitted in a similar manner, but frequencies farther from the center operational frequency may not be transmitted (or may be dampened or reflected significantly more than the center operational frequency). The center operational frequency may not correspond to a peak response frequency within the operational spectrum. When the operational spectrum is determined by cutoff frequencies resulting from a filter or channel, the center operational frequency may be a central frequency between the upper cutoff frequency and lower cutoff frequency and may correspond to a center of the operational spectrum (e.g., as determined by frequency responses that are linearly or logarithmically scaled). The center operational wavelength is the wavelength of the electromagnetic wave having the center operational frequency. It will be appreciated that the center operational wavelength may vary depending on the medium in which the electromagnetic wave is being transmitted.

Unless otherwise defined, all terms (including technical and scientific terms) used herein have the same meaning as commonly understood by one of ordinary skill consistent with their meaning in the context of the relevant art and/or the present application.

According to an embodiment, a traveling-wave directional filter (DF) may be fabricated using a multilayer liquid crystal polymer (LCP) substrate. For example, the traveling-wave DF may operate at about 95 GHz. The DF may comprise two dual-slot directional couplers and one two-wavelength loop resonator. To improve directivity and reduce insertion loss, cascaded DFs were also designed and characterized. The proposed DFs have no critically sized features, and were fabricated on 12 in×18 in LCP panels by using commercially available large-scale printed circuit board technologies.

I. Dual Slot Directional Coupler

The traditional traveling-wave DF may comprise loop resonators and quarter-wavelength directional couplers, as illustrated in FIG. 1(*d*). The couplers can be designed either using planar parallel lines with narrow coupling gaps or vertically parallel lines in multilayer thin substrates. Some conventional directional couplers are based on double-sided microstrips coupled through a slot with a length of quarter wavelength in multilayer substrates. However, these conventional structures are not suitable for high frequency applications due to the aforementioned problems of the reflection and coupling efficiency.

The embodiments herein provide a new type of dual-slot microstrip directional coupler. The microstrip directional coupler may be provided with three-layer liquid crystal polymer (LCP) substrates. Although other dielectric materials may be used, LCP is a preferable material for the filters with multilayer structures due to its low loss and low dielectric constant, particularly at millimeter-wave frequencies. According to an embodiment, a directional coupler comprises two parallel conductive strips on the top and bottom layers, respectively, a shared ground plane in the inner layer, and two rectangular slots distributed in the ground plane spaced apart with a pitch of a quarter wavelength of the microstrip.

A. Slot Coupling of Vertically Overlapped Microstrips

A configuration of a coupler having two vertically overlapped microstrips and one coupling slot and its equivalent circuit is illustrated in FIG. 2(*a*). Electric fields along the propagation direction of the guided wave guided by the directional coupler of FIG. 2(*a*) are shown in FIG. 2(*b*). In detail, the coupler of FIG. 2(*a*) comprises a first microstrip 10*a* and a second microstrip 10*b*. The first microstrip 10*a* comprises a conductive strip 12*a* spaced apart from ground plane 16 by a first LCP layer 14*a*. The second microstrip 10*b* comprises a conductive strip 12*b* spaced apart from ground plane 16 by a second LCP layer 14*b*. As will be appreciated, the first and second microstrips 10*a*, 10*b* share ground plane 16 and are formed at opposite sides of ground plane 16. The first and second microstrips may be configured to transmit RF signals at the same operational frequencies (typically, a range of operating frequencies). Generally, the spacing of the conductive strips 12*a*, 12*b* apart from ground plane 16 (height (h)), the dielectric constant of the substrate 14*a*, 14*b* between 12*a*, 12*b*, and ground plane 16, and the width (w) of the conductive strips 12*a*, 12*b* may determine the impedance of the microstrips, as the following formula $$Z = \begin{cases} \dfrac{60}{\sqrt{\varepsilon_e}} \ln\left(\dfrac{8h}{w} + \dfrac{w}{4h}\right) & \text{for } w/h \le 1 \\ \dfrac{120\pi}{\sqrt{\varepsilon_e}\,[w/h + 1.393 + 0.667\ln(w/h + 1.444)]} & \text{for } w/h \ge 1 \end{cases}$$

$$\varepsilon_e = \frac{\varepsilon_r + 1}{2} + \frac{\varepsilon_r - 1}{2} \frac{1}{\sqrt{1 + 12h/w}}$$

where Z is the impedance of the conductive strip 12*a*, 12*b*, and $\varepsilon_r$ is the permittivity of the dielectric layer 14*a*, 14*b* acting as the substrate for the microstrip 10*a*, 10*b*. Typically, the operating spectrum of the microstrips 10*a*, 10*b* is below the cut-off frequency of their high order modes, including $TM_0$ mode $$\left(f_{cut} = \frac{c}{2\pi h}\sqrt{\frac{2}{\varepsilon_r - 1}}\tan^{-1}\varepsilon_r\right),$$

$TE_1$ mode $$\left(f_{cut} = \frac{c}{4h\sqrt{\varepsilon_r - 1}}\right),$$

transverse resonance $$\left(f_{cut} = \frac{c}{\sqrt{\varepsilon_r}\,(2w+h)}\right),$$

and parallel plate mode $$\left(f_{cut} = \frac{c}{2h\sqrt{\varepsilon_r}}\right)$$

(c is the speed of light in free space). In some examples, the corresponding cut-off wavelength $\lambda_{cut}$ is 4 w, and the operating wavelengths of the spectrum is greater than 4 times the width of the conductive strip 12*a*, 12*b*. Thus, the DFs can be implemented with various widths w and heights h of the conductive strips 12*a*, 12*b* recognizing that w and h should be small enough to avoid high order modes at millimeter wave frequencies and obtain sufficient coupling through the slot 20. About a 50-Ω microstrip (e.g. 40 to 60-Ω) may be preferred for circuit connection, but other impedances may also be used for the DFs.

Ground plane 16 may be a planar sheet or planar plate of conductive material (e.g., metal, such as Al, Cu, Au, Ag, etc.). The ground plane 16 may also be non-planar and curve. In such implementations, first and second conductive strips 12*a* and 12*b* are provided to have similar curve shapes to conformally be formed above and below the ground plane 16 and maintain a constant spacing therebetween. Ground plane 16 includes a slot 20 formed therein and interposed between the first and second conductive strips 12*a* and 12*b* so that the slot 20 extends under conductive strip 12*a* and extends across and above conductive strip 12*b*. The first and second LCP layers 14*a*, 14*b* are dielectric layers and maintain a predetermined spacing between the ground plane 16 and the corresponding conductive strips 12*a*, 12*b*. The first microstrip 10*a* may be formed by layering the first LCP layer 14*a* on the ground plane 16 and forming the conductive strip 12*a* on the first LCP layer 14*a* (e.g., by patterning a metal layer formed on the first LCP layer 14*a* to form the conductive strip 12*a*). The second microstrip 10*b* may be formed by patterning conductive strip 12*b* on the second LCP layer 14*b* and then attaching the second LCP layer 14*b* to the bottom surface of the ground plane 16 with an adhesive 18.

When an electro-magnetic signal is sent into Port 1, it can excite an even mode to Port 4 and an odd mode to Port 3. For the even mode, the electric field is evenly symmetric with respect to the center line, thus no current flows between the two conductive strips. For the odd mode, the field shows an odd symmetry, and a voltage null exists between the two strip conductors. Thus, these two modes propagate in opposite directions. Due to the weak coupling, their amplitudes are similar. The equivalent circuit models of these two modes are also shown in FIG. 2(*b*). $C_{12}$ represents the coupling capacitance between the top and bottom conductive strips 12*a* and 12*b*, and $C_{11}$ and $C_{22}$ represent the capacitances of these two conductive strips to the shared ground.

Ansys high frequency structural simulator (HFSS) was employed to design and simulate the full-wave models of the vertically coupled microstrips and the following devices. As shown in FIG. 2(*a*), a bond ply is implemented as the adhesive 18, and the bond ply is 50-μm-thick LCP, and the top and bottom substrates are 100-μm-thick LCP and 50-μm-thick LCP, respectively, thus spacing the conductive strips 12*a*, 12*b* equally apart from the respective upper and lower surfaces of the ground plane 16. For example, respective spaces (distances) between the upper and lower surfaces and the conductive strips 12*a* and 12*b* may be less than one tenth of a wavelength of the microstrip operational frequency (e.g., as applied to Port 1). The dielectric constant and loss tangent of LCP at 95 GHz are 3.2 and 0.0045, respectively. The top conductive strip 12*a* has a length of 5 mm and a width of 0.24 mm, providing an impedance of 50Ω for probing. A narrower width of 0.16 mm is chosen for the bottom conductive strip 12*b* to suppress the dispersion of the loop resonator in the DFs. As can be seen in FIGS. 2(*a*) and 2(*b*), $S_{31}$ and $S_{41}$ represent the odd mode and even mode, respectively, due to their propagation directions depicted as the arrows. The tolerance analysis of the substrate thickness and slot size is shown in FIGS. 2(*c*) and 2(*d*). The total thickness of the bond ply and bottom LCP is denoted as Tb. As shown in FIG. 2(*c*), using a thin substrate can enhance the coupling efficiency. When Tb=50 μm, the simulated $S_{31}$ and $S_{41}$ are 1.8 dB higher than their counterparts at Tb=100 μm. However, the conductive strips on a 50-μm-thick LCP substrate have higher propagation loss. Increasing the size of the slot can also enhance the coupling efficiency, however, increasing the reflection, as shown in FIG. 2(*d*). A large slot may introduce large discrepancy between the even mode and odd mode, which can be explained by the equivalent circuit models in FIGS. 2(*a*) and (*b*). The odd mode is controlled by $C_{11}$, $C_{22}$, and $C_{12}$, while the even mode is determined by $C_{11}$ and $C_{22}$. Enlarging the slot may increase $C_{12}$, thus enhancing the odd mode faster than the even mode. When the slot width, Ws, equals a quarter of wavelength, a single slot-coupled directional coupler may be achieved, whose reflection, however, is significant at the W-band, i.e., 75-110 GHz. Based on the aforementioned analysis, to compensate microstrips' loss, reflection, and coupling efficiency, Tb is chosen as 100 μm, and the width, Ws, and length, Ls, of the slot are 0.12 mm and 0.5 mm, respectively. The simulated magnitude of the even mode, $S_{41}$, and odd mode, $S_{31}$, is −13.6 dB and −12.9 dB at 95 GHz, respectively, and the reflection, $S_{11}$ is less than −12 dB from 70 to 100 GHz. The empirical tolerance of the fabrication and multilayer lamination is less than 15 and 10 μm, respectively, which introduces little impact to the slot coupling.

B. Dual-Slot Directional Coupler

The configuration and mechanism of a directional coupler according to an embodiment are shown in FIGS. 3(*a*) and 3(*b*) (being a cross sectional view of the exploded perspective view of FIG. 3(*a*) taken along line IIIb-IIIb'). The structure of the directional coupler of FIGS. 3(*a*) and 3(*b*) may be the same structure as discussed above with respect to FIG. 2(*a*), and thus the repetitive description of the structure shared with embodiment of FIG. 2(*a*) is avoided. The structure of the directional coupler of FIGS. 3(*a*) and 3(*b*) differs from that of FIG. 2(*a*) in that two slots 20-1, 20-2 are provided in the shared ground plane 16 with a spacing therebetween. The spacing between slots 20-1, 20-2 provides a phase delay of 90° with an optimized distance between the centers of slots 20-1, 20-2 of $p_s$=a distance of a quarter wavelength of the designed operational frequency of the DF (in this example, $p_s$=0.34 mm) along the propagation direction of the guided wave. Due to the weak coupling of the slots, the two even modes and two odd modes excited by these two slots have similar amplitudes to one another. For example, the coupling of signals between an upper microstrip and a lower microstrip of FIG. 3(*a*) is occurred through the two slots, and the coupling of signals may not be significant because the slots are small enough, and the amplitudes of the coupled signals formed through the respective two slots may not be substantially different from one another. The two even modes, propagating toward Port 4, are in-phase at the second slot, thus adding constructively, while the two odd modes, propagating toward Port 3, are 180° out-of-phase at the first slot, thus providing a high isolation, as shown in FIG. 3(*c*). For example, the two odd modes, propagating toward port 3, have similar amplitudes to each other, are in antiphase with each other, and interfere destructively with each other. The simulated S-parameters of the dual-slot directional coupler are shown in FIGS. 3(*c*) and (*d*), showing good directivity. $S_{41}$ is −7.5 dB, $S_{31}$ is less than −30 dB, and $S_{11}$ is less than −30 dB at 95 GHz. Due to the high directivity, the proposed directional coupler can be utilized to design DFs. The distance between the two rectangular slots formed in the ground plate is a quarter of a wavelength of an electro-magnetic wave applied to the Port 1 of the microstrip. It should be noted that reference to distances in terms of wavelength throughout this disclosure refers to the wavelength of an electromagnetic wave with respect to a corresponding medium through which the electromagnetic wave is traveling (e.g., the wavelength of the electromagnetic wave as it travels along the microstrip through the LCP dielectric). Thus, the same wavelength distance (referenced in terms of wavelength) may have different physical distances with respect to different mediums. The slots 20 (in this example, 20-1, 20-2) of the disclosed embodiments may be a hole formed in the ground plane. For example, the slots 20-1, 20-2 may penetrate through the ground plane 16. In certain embodiments, the slots 20-1, 20-2 may have different shapes other than rectangular. For example, the slots 20-1, 20-2 may be rounded holes, elliptical holes, or other shapes of holes. These shapes of holes may be applied to the slots 20 of other embodiments of the present disclosure.

II. Directional Filter Design

Figure 5B:
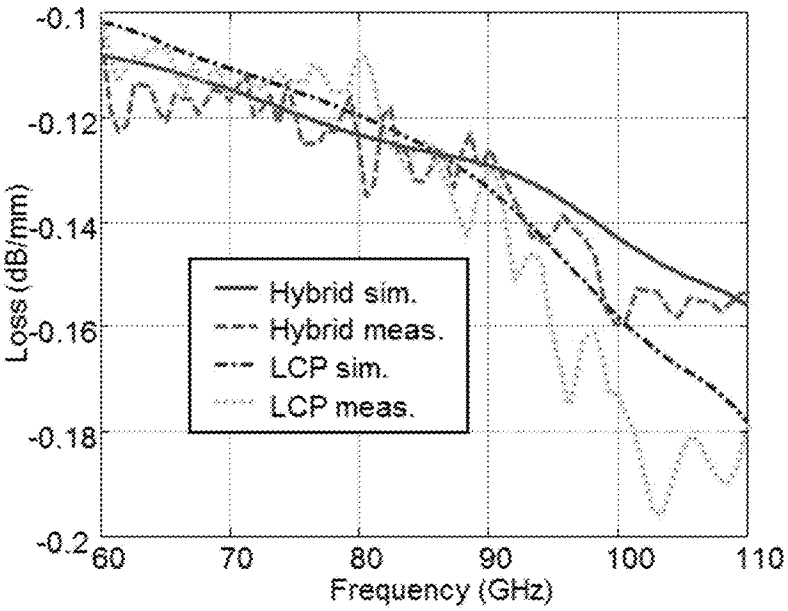
FIG. 5(*b*) illustrates simulated and measured propagation loss of the top and bottom conductive strips in a DF according to an embodiment of the present disclosure.
Figure 5A:
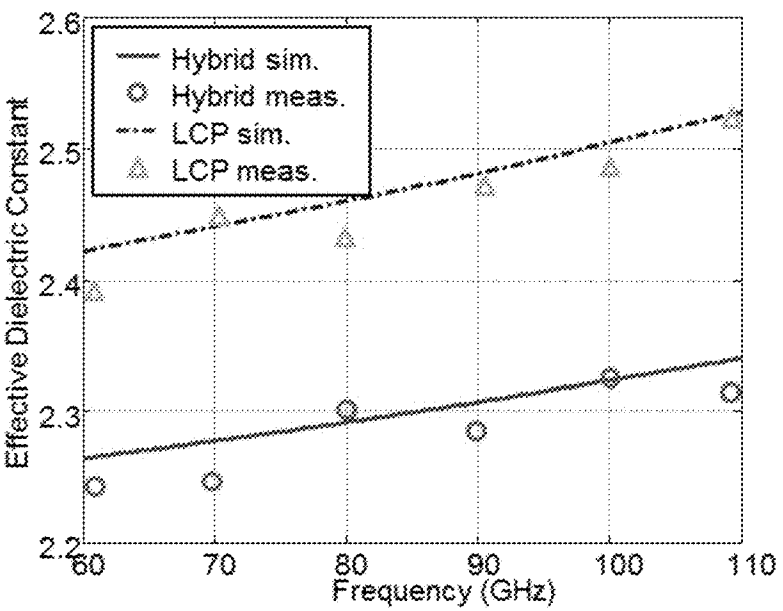
Figure 6A:
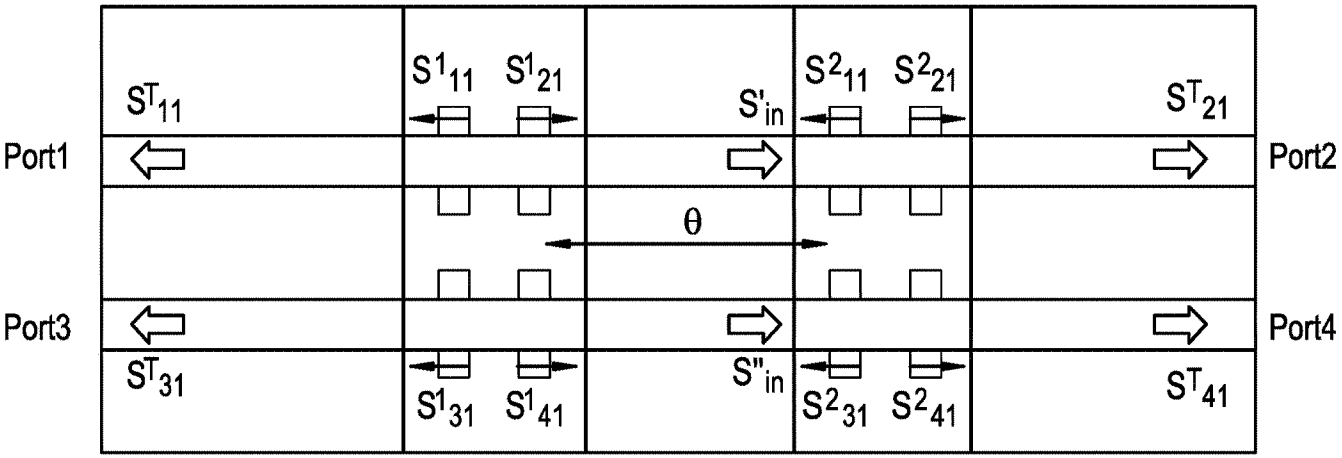
FIGS. 6(*a*) and 6(*b*) illustrate a directional filter including eight slots and two coupling loops according to an embodiment of the present disclosure.
Figure 6B:
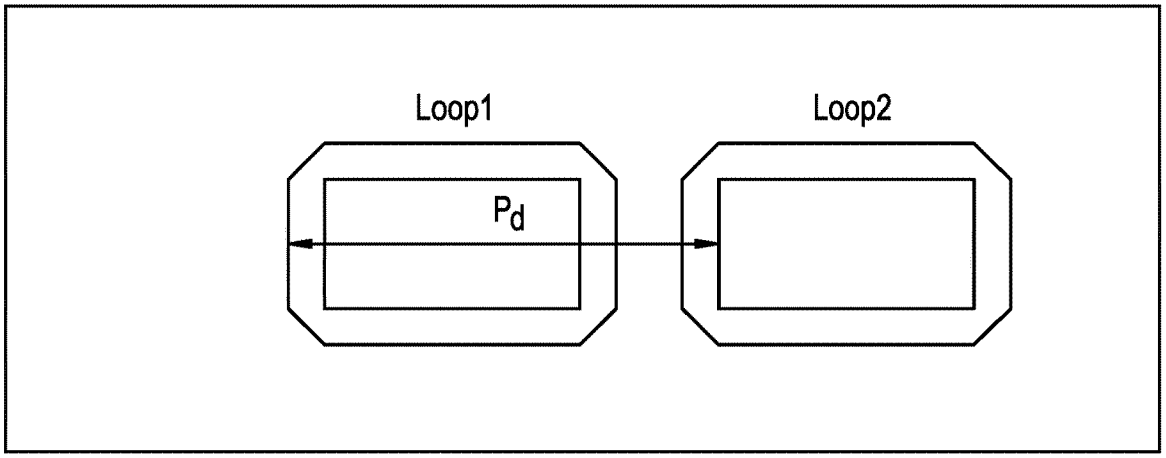
Figure 6D:
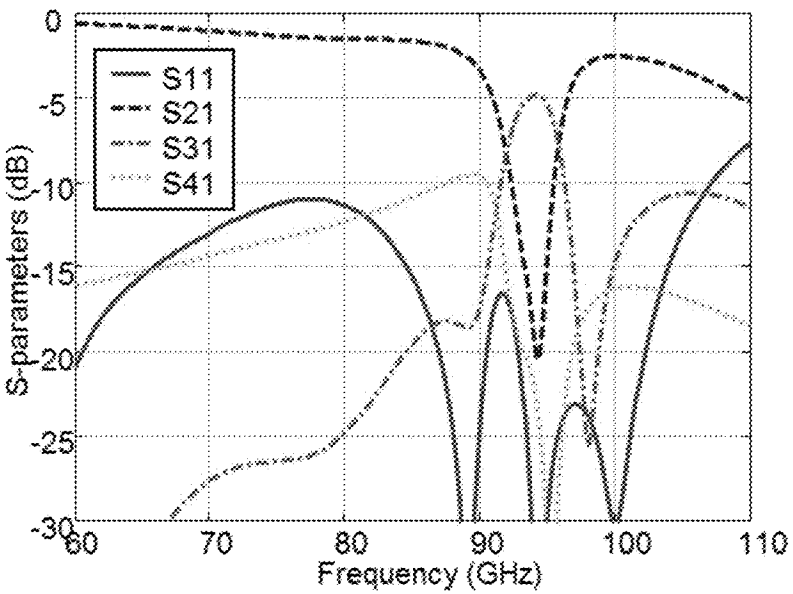
Figure 6C:
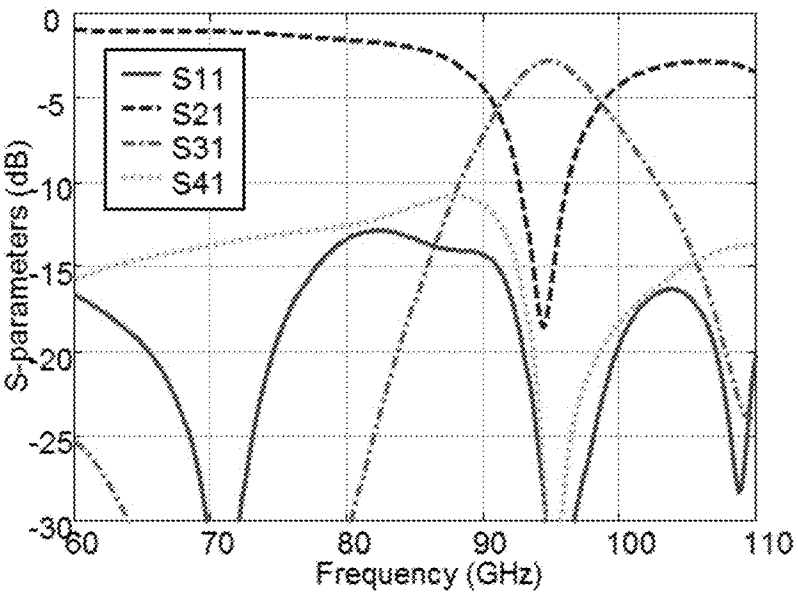

Another key element to construct a traveling-wave DF is loop resonator. DFs may utilize loop resonators with a mean circumference of one wavelength at its center frequency, which, however, may not be beneficial for high frequencies. For example, a mean circumference of a loop may be a mean distance of the loop. For example, a loop distance may be different at its inner most portion from its outer most portion, and a mean circumference of a loop may have the same value as a distance of a center line of the loop. As the frequency increases to W-band, e.g., 95 GHz, the microstrips and slots become electrically "large" in terms of wavelength. In this case, the one wavelength loop resonator may not provide enough space to combine with the proposed dual-slot directional couplers efficiently. Meanwhile, the limited loop length of a one wavelength loop with "large" linewidth may increase mutual coupling between the microstrips in the loop, thus reducing the Q-factor or quality factor. For example, when the Q-factor is reduced, signal loss is increased. To solve this problem, the mean circumference of the loop resonator is chosen as two wavelengths of the microstrip at 95 GHz. The configuration of the utilized loop resonators is shown in FIGS. 4(*a*) and 4(*b*). The mean length and width of the loop resonator may be about 1.32 mm and about 0.71 mm, respectively. The width of conductive loop 12*c* is 0.16 mm, providing an impedance of about 62Ω to suppress the dispersion of the loop resonator. FIGS. 5(*a*) and 5(*b*) respectively show the simulated and measured effective dielectric constant and propagation loss of the microstrips with a width of 160 micrometer for conductive loop 12*c* on a 100 micrometer LCP substrate 14*a* and a 50 micrometer LCP substrate 14*b* laminated with a 66 micrometer Arlon GenClad (AG) bond ply 18. FIG. 5(*b*) shows that the propagation loss is 0.156 dB/mm at 95 GHz. The simulated unloaded Q-factor of the loop resonator is 58 at 95 GHz. Thus, the corresponding averaged attenuation of the loop can be calculated as 0.226 dB/mm, including radiation loss and propagation loss of the loop line. The averaged radiation loss can be obtained by subtracting the propagation loss shown in FIG. 5(*b*) from the total loss. The estimated radiation loss is approximately 0.065 dB/mm at 95 GHz, which may not be significant with respect to the total loss.

FIGS. 4(*a*), 4(*b*) and 4(*c*) illustrate exemplary structure of a DF with loop resonators according to embodiments of the invention. FIG. 4(*a*) illustrates structure applicable to the symmetric loop resonator DF of FIG. 4(*b*) and to the structure of the asymmetric loop resonator DF of FIG. 4(*c*). Much of the structure illustrated in FIG. 4(*a*) may be the same as that described above with respect to FIGS. 2(*a*) and 3(*a*) and thus repetitive description may be avoided here. As shown in FIG. 4(*a*), two microstrips 10*a*', 10*b*' are formed side by side on the same side of ground plane 16. In this example, the conductive strips 12*a* and 12*b* of microstrips 10*a*' and 10*b*' extend in a parallel direction across the top surface of LCP dielectric 14*a*. As with the previous embodiments, the two microstrips 10*a*' and 10*b*' are formed with the same ground plane 16. A conductive loop 12*c* is formed on the opposite side of the ground plane 16 than conductive strips 12*a* and 12*b*. LCP dielectric 14*b* and adhesive 18 are formed between the conductive loop 12*c* and ground plane 16. Conductive loop 12*c* may be spaced apart from ground plane 16 substantially the same distance as the spacing of conductive strips 12*a* and 12*b* from ground plane 16. Conductive loop 12*c* and conductive strips 12*a* and 12*b* may be formed of patterned conductive material, such as Al, Cu, Ag, Ag., etc. Two pairs of slots are formed in ground plane 16. Slots 20-1 and 20-2 are positioned below conductive strip 12*a* such that conductive strip 12*a* crosses over slots 20-1 and 20-2. Slots 20-3 and 20-4 are positioned below conductive strip 12*b* such that conductive strip 12*b* crosses over slots 20-3 and 20-4.

FIGS. 4(*b*) and 4(*c*) are bottom up views of a symmetric loop resonator DF (FIG. 4(*b*)) and an asymmetric loop resonator DF (FIG. 4(*c*)). FIGS. 4(*b*) and 4(*c*) illustrate conductive loop 12*c* on LCP dielectric 14*b*. Positions of slots 20-1 to 20-4, conductive strips 12*a* and 12*b* and ports Port 1 to Port 4 are also represented in the left hand side of FIGS. 4(*b*) and 4(*c*) to show relative positioning with conductive loop 12*c*, although these structures may not typically be seen from a bottom up view. The right hand side of FIGS. 4(*b*) and 4(*c*) illustrate signals as they travel along the microstrips 10*a*, 10*b* and along loop 12*c*. The different widths of the arrows represent the relative strengths of these signals with respect to each other (thus the smallest width arrow represents the smallest signal strength of the signals represented in FIGS. 4(*b*) and 4(*c*). Green arrows represent portions of the input signal that are travelling or had previously traveled in the clockwise direction with respect to the bottom up views of FIGS. 4(*b*) and 4(*c*). Red arrows represent portions of the input signal that are travelling or had previously traveled in the counter clockwise direction with respect to the bottom up views of FIGS. 4(*b*) and 4(*c*). The lower and upper illustrations of the right hand side of FIGS. 4(*b*) and 4(*c*) are cross sectional views taken along conductive strips 12*a* and 12*b*, respectively, to show the transfer of signals between conductive strips 12*a*, 12*b* (and microstrips 10*a*, 10*b*) and conductive loop 12*c*. As described in more detail below, differences between the symmetric loop resonator DF of FIG. 4(*b*) and the asymmetric loop resonator DF of FIG. 4(*c*) relate to the positioning of the conductive loop 12*c* with respect to these slots 20-*n*.

A. Single-Loop Directional Filter

1) Symmetric Loop:

A bottom up view of a DF with a symmetric loop is shown in FIG. 4(*b*). As shown in FIG. 4(*b*), slots 20-1 to 20-4 are symmetrically positioned with respect to the loop center 12*c*-1 of conductive loop 12*c*. Distances (as measured along the center of the width of the conductive loop 12*c*) between slot 20-1 and slot 20-2 and between slot 20-3 and slot 20-4 are each substantially 90° while the distance between slot 20-1 and 20-3 and the distance between slot 20-2 and 20-4 are each 270°. Distances in degrees herein refers to distances in wavelengths (e.g., a wavelength of electromagnetic wave of the center frequency of the operation frequency of the DF) where 360° refers to a full wavelength (and thus 90° refers to a quarter wavelength, 180° refers to half wavelength, 270° refers to a three-quarters wavelength, etc.). For purposes of illustration, the arrows depicting the distances described with respect to left portions of FIGS. 4(*b*), (*c*) and (*f*) are located outside the center of the width of the conductive loop 12*c* (for purposes of providing a clearer illustration), but it should be appreciated that these arrows represent the distances as measured along the center of the width of the conductive loop 12*c*.

According to the mechanism of the directional couplers described in FIG. 3(*b*), the signal input to Port 1 will be output at Port 4, and isolated and not output at Port 3. As will be appreciated, a signal input via Port 1 from microstrip 10*a* (via conductive strip 12*a*) will couple to conductive loop 12*c* at slot 20-1 and 20-2 (the first directional coupling). At each slot 20-1, 20-2, the coupled signal will travel in both directions along conductive loop 12*c*, where the composite signal traveling in the counterclockwise direction (red arrow in FIG. 4(*b*)) is much stronger (such as more than 20 dB stronger) than that traveling in the clockwise direction (green arrow in FIG. 4(*b*)) due to the first directional coupler. When these two signals arrive at the second directional coupler (slots 20-3 and 20-4), the counterclockwise one will mainly travel (via microstrip 10*b* with conductive strip 12*b*) to port Port 3 with a small portion traveling to port Port 4, and vice versa for the clockwise one due to the second directional coupler. Thus, the total signals at Port 3 and Port 4 will be a combination of the second directional coupling of the signals traveling in counterclockwise and clockwise directions on the conductive loop 12*c*.

The composite signals traveling in the counterclockwise and clockwise directions on conductive loop 12*c* reach the second directional coupler (slots 20-3 and 20-4) and couples to therethrough to microstrip 10*b* (with conductive strip 12*b*). The coupled counterclockwise and clockwise composite signals on microstrip 10*b* travel in both directions from slots 20-3 and 20-4 (the second directional coupler), forming interfering signals traveling towards and exiting Port 3 and Port 4. The signal input on microstrip 10*a* on Port 1 is coupled to microstrip 10*b* and output on Port 3 without substantial effect on Port 4 due to the two directional couplers, as illustrated in FIG. 4(*b*).

Transfer of signals in the other direction achieve a similar result such that a signal provided by Port 3 is output on Port 1 while reducing or substantially preventing signal transmission from Port 3 and Port 2. Similarly, the slot spacings over conductive loop 12*c* provide signal connections between Port 2 and Port 4 (while reducing or substantially preventing (reducing to a negligible amount) signal connections from Port 2 to Port 3 and from Port 4 to Port 1). In this example, the pitch between two slots, $p_s$, is set to 0.35 mm, instead of 0.34 mm, to achieve a better directivity for the DF. However, the pitch $p_s$ may vary, such as by about 20% from a quarter wavelength of the center operational frequency, such as between 0.3 to 0.45 mm for a DF having an operational frequency centered at 95 GHz. FIG. 4(*d*) shows the simulated S-parameters of the proposed symmetric DF. The insertion loss of the passband, $S_{31}$, is −4.6 dB at Port 3 at 94 GHz, and the 3-dB bandwidth is 5.3% centered at 94 GHz. It should be noted that the through loss, $S_{21}$, is as high as −9.5 dB, which is limited by the coupling efficiency, and can be reduced by cascading DFs. The isolation, $S_{41}$, and reflection, $S_{11}$, are better than −17 dB at 94 GHz at Port 4 and Port 1, respectively. It will be appreciated that the slot pairs (20-1, 20-2 and 20-3, 20-4) need not vertically align with each other as shown in FIG. 4(*b*). For example, in some implementations, the slots 20-1 to 20-4 may all be shifted by a distance x in the same direction (clockwise or counter clockwise) along loop 12*c*. Thus, the distances between slot pair 20-1, 20-2 and slot pair 20-3, 20-4 and the distances between the slots of each of these slot pairs would be the same as that described herein with respect to FIG. 4(*b*) and achieve similar results.

However, the symmetric loop may reduce the directivity of the DF inherently. As shown in FIG. 4(*b*), the phase between slot 20-1 and slot 20-2 and between slot 20-3 and slot 20-4 is approximately 90°, and the phase between slot 20-1 and slot 20-3 and between slot 20-2 and slot 20-4 is 270°. With such a phase distribution, the signals transmitted from Port 1 to Port 3 in the clockwise and anticlockwise directions are 180° out of phase, which degrades the directivity.

2) Asymmetric-Loop Directional Filter:

To improve the directivity of the DF, an embodiment of the present disclosure has an asymmetric loop topology, as shown in FIG. 4(*c*). This asymmetric phase topology is similar to that of the standing-wave DF described in FIG. 1(*b*). As compared to the symmetric arrangement of the slots 20-1 to 20-4, slot pair 20-1, 20-2 and slot pair 20-3, 20-4 may be shifted along conductive loop 12*c* closer to each other on one side of the conductive loop 12*c* by about ¼ of the center operational wavelength (and shifted away from each other on the other side of the conductive loop 12*c* by about ¼ of the center operational wavelength). In this example, both slot pairs (slot pair 20-1, 20-2 and slot pair 20-3, 20-4) are shifted ⅛ of the center operational wavelength along conductive loop 12*c* in the left direction with respect to the viewpoint of FIGS. 4(*b*) and 4(*c*) to reduce the distance therebetween on the left side of the conductive loop by ¼ of the center operational wavelength and to increase the distance therebetween on the right side of the conductive loop by ¼ of the center operational wavelength (as compared to the arrangement of FIG. 4(*b*)). Other features of the DF of FIG. 4(*c*) may be the same as that described herein with respect to FIG. 4(*b*). In the example of FIG. 4(*c*), where the center operational frequency is 95 GHz, the center of the conductive loop 12*c*-1 is shifted with respect to the slots 20-1 to 20-4 by about 0.175 mm with respect to the symmetric arrangement of FIG. 4(*b*), but also may be shifted by other amounts, such as within the range of 0.15-0.23 mm with respect to the slots (about one eight of the wavelength of the microstrips at 95 GHz). Slots 20-1 and 20-3 offset with respect to loop center 12*c*-1 and thus the group of slots 20-*n* are positioned asymmetrically with respect to loop center 12*c*-1. In this embodiment, the phase between slot 20-1 and slot 20-3 and between slot 20-2 and slot 20-4 is approximately 180° and 360°, respectively. With such a phase distribution, the signals transmitted from Port 1 to Port 3 in the clockwise and anticlockwise directions interfere constructively, and the counterparts from Port 1 to Port 2 and from Port 1 to Port 4 are 180° out of phase and thus destructively interfere, thus improving the directivity of the DFs. Thus, signals are able to be transmitted between Port 1 and Port 3 and between Port 2 and Port 4 while substantially preventing transmission between Port 1 and Port 4 and between Port 2 and Port 3.

Specifically, in connection with the example discussed above regarding an input signal on Port 1, the destructive interference of the two clockwise traveling signal portions on conductive loop 12*c* (initiating from slots 20-1 and 20-2) may be insufficient to eliminate a signal traveling in the clockwise direction on conductive loop 12*c* to slots 20-3 and 20-4. Thus, a composite clockwise signal may continue its transmission along the conductive loop 12*c* in the clockwise direction to slots 20-3 and 20-4. The strength of the signal input on Port 1 as it travels to slot 20-2 on microstrip 10*a* may be weakened after coupling to conductive loop 12*c* via slot 20-1. Thus, the composite signal traveling in the clockwise direction on conductive loop 12*c* from the first directional coupler may have a phase determined by the signal portion coupled at slot 20-1 to conductive loop 12*c* (this signal portion being stronger and 180 degrees out of phase with the signal coupled to conductive loop 12*c* at slot 20-2).

Thus, composite signals (having phases corresponding to the coupling of the microstrip signal at port 20-1) may travel in both directions (clockwise and counterclockwise) around conductive loop 12*c*. Referring to the embodiment of FIG. 4(*b*) (the symmetric loop topology) with a signal input via Port 1, upon reaching slot 20-3 via conductive loop 12*c*, the clockwise composite signal will be 180° out of phase with the counterclockwise composite signal (travel paths of 450°−270°=180°) and destructively interfere, weakening transmission of the signal coupled to microstrip 10*b* and exiting Port 3. In addition, upon reaching slot 20-4, the clockwise composite signal will be in phase with the counterclockwise composite signal (travel paths of 360°−360°=0°) and constructively interfere and thus increasing a signal strength of the portion traveling towards Port 4 on microstrip 10*b*.

Referring to the embodiment of FIG. 4(*c*) (the asymmetric loop topology), by shifting the location of the slot pair 20-1, 20-2 with respect to slot pair 20-3, 20-4, such resulting constructive interference occurring at slot 20-3 and destructive interference occurring at slot 20-4 may be reversed. Specifically, the clockwise composite signal coupling with microstrip 10*b* exiting slot 20-3 and traveling towards Port 3 constructively interferes with the counterclockwise composite signal traveling to Port 3 (coupled to microstrip 10*b* via slots 20-3 and 20-4) (consider travel paths to slot 20-3 of 540°−180°=360°. In addition, the clockwise composite signal coupling with microstrip 10*b* exiting slot 20-3 and slot 20-4 and traveling towards Port 4 destructively interferes with portion of the counterclockwise composite signal traveling towards Port 4 (coupled to microstrip 10*b* via slots 20-3 and 20-4) (consider travel paths to slot 20-4 of 450°−270°=180° as well as the portion of clockwise composite signal exiting slot 20-3 traveling toward Port 4 is in phase with that portion of the clockwise composite signal exiting slot 20-4 traveling towards Port 4). It will be appreciated that the slot pairs (20-1, 20-2 and 20-3, 20-4) need not vertically align with each other as shown in FIG. 4(*c*). For example, in some implementations, the slots 20-1 to 20-4 may all be shifted by a distance x in the same direction (clockwise or counter clockwise) along loop 12*c*. Thus, the distances between slot pair 20-1, 20-2 and slot pair 20-3, 20-4 and the distances between the slots of each of these slot pairs would be the same as that described herein with respect to FIG. 4(*c*) and achieve similar results.

The simulated S-parameters of the asymmetric single-loop DFs are shown in FIG. 4(*e*), revealing an improved directivity. The 3-dB bandwidth of the passband is reduced from 5.3% to 4.9%, the out-of-band rejection is improved more than 5 dB, and the isolation and reflection are also improved by a factor of 6 and 2 dB, respectively.

In both the symmetric-loop DF and asymmetric-loop DF of the examples of FIGS. 4(*b*) and 4(*c*), the length of the conductive loop 12*c* is 720° or two wavelengths. Thus, spacing between the microstrips 10*a* and 10*b* (and conductive strips 12*a*, 12*b*) may be made larger (such as a spacing greater than 90°, or about half the operational wavelength or greater) to avoid interference between these microstrips at high operating frequencies, such as in the millimeter wavelength range or higher frequencies. In addition, the widths of the conductive strips 12*a*, 12*b* and the conductive loop 12*c* may be made relatively wide to adapt to a relatively thick substrate, e.g., larger than 5% and less than 15% of a wavelength for the operating spectrum (which may reduce the propagation loss of the microstrips)—due to the increased spacing between the conductive strips 12*a*, 12*b*, increasing the width of the conductive strips 12*a*, 12*b* and the conductive loop 12*c* does not significantly increase interference due to closer positioning of these conductors. For example, the width of the conductive strips 12*a*, 12*b* and/or the conductive loop 12*c* may be greater than 5% of the operational wavelength, or greater than about 8% of the operational wavelength. In some examples, the width of conductive strips 12*a*, 12*b* and/or the conductive loop 12*c* may be about a quarter of the operational wavelength. The upper limit may avoid the high order modes for the operating spectrum, as discussed herein.

Other configurations achieving similar results may also be implemented. For example, the conductive loop 12*c* may have a length of n×lambda, where lambda is the operational wavelength of the DF and n is an integer two or greater. In the embodiments of FIGS. 4(*b*) and 4(*c*), n is equal to 2, but in other embodiments n may be 3, 4, 5, etc. Larger conductive loops 12*c* allow for further separation of the conductive strips 12*a*, 12*b* but may also invite additional loss due to the larger distances the signal must travel along the conductive loop 12*c*. FIG. 4(*f*) illustrates exemplary spacing of slots 20-1 to 20-4 for an asymmetric loop configuration where the loop length is n×lambda, where n=2 or more. In this example, the phase between microstrips 10*a* and 10*b* (and conductors 12*a* and 12*b*) may be as large as 180°+n×180°, i.e., a distance of $(n+1)\times\lambda/2$, where n is an integer equal to two or more.

It will be appreciated that the slot pairs 20-1, 20-2 and 20-3, 20-4 may be spaced symmetrically with respect to conductive loop 12*c*, or these slot pairs may be spaced at some other distances from each other along conductive loop 12*c* (although the spacing between each pair of slots is preferably maintained at a quarter wavelength).

B. Double-Loop DF

According to an embodiment of the present disclosure, to improve the directivity and reduce the insertion loss, the traveling-wave DFs may have a structure of cascaded loop resonators, as shown in FIG. 1(*d*), and the standing-wave DFs may have cascaded identical DFs in the direction of terminating lines. According to an embodiment of the present disclosure, two identical traveling wave DFs are cascaded in the direction of terminating lines, as shown in FIG. 6(*a*). The Port 1 and Port 3 of the second DF connect to the Port 2 and Port 4 of the first DF, respectively. $S_{21}$, and $S_{41}$, of the first DF will travel to the second DF as the input signals, and may be depicted by the following formula:

$$S'_{in}=S^1_{21}e^{-j\theta}$$

$$S''_{in}=S^1_{41}e^{-j\theta} \quad (1)$$

where $S^1_{21}$ and $S^1_{41}$ are the through and isolated signals of the first DF, respectively, θ is the phase delay between two DFs, and $S'_{in}$ and $S''_{in}$ are the input signal to Port 1 and Port 3 of the second DF, respectively.

Due to the symmetry of the proposed DF $$S^1_{21}=S^1_{12}=S^1_{34}=S^1_{43}$$

$$S^1_{41}=S^1_{23} \quad (2)$$

both $S'_{in}$ and $S''_{in}$ will be filtered with the same mechanism.

Thus, the fundamental response of the second DF will be the overlapped responses of these two signals $$S^2_{11}=S'_{in}S^1_{11}+S''_{in}S^1_{31}=(S^1_{21}S^1_{11}+S^1_{41}S^1_{31})e^{-j\theta}$$

$$S^2_{21}=S'_{in}S^1_{21}+S''_{in}S1\ 41=(S^1_{21}S^1_{21}+S^1_{41}S^1_{41})e^{-j\theta}$$

$$S^1_{31}=S'_{in}S^1_{31}+S''_{in}S^1_{11}=(S^1_{21}S^1_{31}+S^1_{41}S^1_{11})e^{-j\theta}$$

$$S^2_{41}=S'_{in}S^1_{41}+S''_{in}S^1_{21}=2S^1_{21}S^1_{41}e^{-j\theta}. \quad (3)$$

$S^2_{11}$ and $S^2_{31}$ may be fed back to the first DF, part of which will contribute to $S^T_{11}$ and $S^T_{31}$, and the rest of which will be reflected back to the second DF as the high-order mutual coupling between two DFs. As shown in FIGS. 4(*e*), $S^1_{11}$, $S^1_{21}$, and $S^1_{41}$ are less than −20, −10, and −17 dB at 95 GHz, respectively. Thus, it is fair to neglect the high-order mutual coupling and high-order items, simplifying our analysis. The S-parameters of the cascaded double-loop traveling-wave DF may be described as follows:

$$S^T_{11}\approx S^1_{11}+S^2_{11}e^{-j\theta}S^1_{12}+S^2_{31}e^{-j\theta}S^1_{14}=S^1_{11}+S^1_{21}(S^1_{21}S^1_{11}+S^1_{41}S^1_{31})e^{-j2\theta}+S^1_{41}(S^1_{21}S^1_{31}+S^1_{41}S^1_{11})e^{-j2\theta}\approx S^1_{11}+2S^1_{21}S^1_{41}S^1_{31}e^{-j2\theta}$$

$$S^T_{21}\approx S^2_{21}=(S^1_{21}S^1_{21}+S^1_{41}S^1_{41})e^{-j\theta}$$

$$S^T_{31}\approx S^1_{31}+S^2_{31}e^{-j\theta}S^1_{34}+S^2_{11}e^{-j\theta}S^1_{32}=s^1_{31}+S^1_{21}(S^1_{21}S^1_{31}+S^1_{41}S^1_{11})e^{-2j\theta}+S^1_{41}(S^1_{21}S^1_{11}+S^1_{41}S^1_{31})e^{-j2\theta}\approx S^1_{31}+S^1_{21}S^1_{21}S^1_{31}e^{-j2\theta}+S^1_{41}S^1_{41}S_{31}e^{-j2\theta}$$

$$S^T_{41}\approx S^2_{41}=2S^1_{21}S^1_{41}e^{-j\theta}. \quad (4)$$

It is noted that the S-parameters of the cascaded DFs have periodic characteristics, which is controlled by the phase delay, θ, between them. $S^T_{31}$ is maximum at θ=nπ (n is an integer), and is minimum at θ=(2n+1) π/2. Limited by the loop dimensions, θ=2π is chosen to reduce the insertion loss, which corresponds to $P_d$=1.9 mm. The simulated S-parameters of the cascaded double-loop DF with $P_d$=1.9 mm are shown in FIG. 6(*c*). The insertion loss, $S_{31}$, is improved to 2.6 dB, and the through loss, $S_{21}$, is reduced to −17 dB at 94 GHz. The isolation is better than −20 dB, and the reflection is less than −11 dB. Due to the weak disturbance coupling between the two DFs, the 3-dB bandwidth of the passband is broadened to 8%. Tuning the phase delay can also introduce two transmission zero points to sharp the passband. As the frequency deviates from the center frequency, the item $S^1_{21}S^1_{21}+S^1_{41}S^1_{41}$ for $S^T_{31}$ in (4) approaches one. Thus, at θ≈(2n+1) π/2, two transmission zero points can be introduced to $S^T_{31}$ to sharp the pass band. The simulated S-parameters of the double-loop DF with $P_d$=2.3 mm are shown in FIG. 6(*d*). The passband width is reduced to 4% centered at 94 GHz with an increased insertion loss of 4.8 dB. In this case, a tunable bandwidth from 4% to 8% can be achieved by tuning $P_d$ from 2.3 to 1.9 mm.

IV. Hybrid Substrates and Measurement

A. Hybrid Substrates

To improve the yield for large panel lamination, 66 μm (2.6 mil) thick Arlon GenClad (AG) 280 bond ply is used to substitute the LCP bond ply. Thus, we adapted the directional couplers and filters in the hybrid substrates. The dielectric constant and loss tangent of the AG bond ply at 95 GHz is approximately 2.82 and 0.005, respectively, which may be calculated using classic ring resonator method and transmission line method. As can be seen in FIGS. 5(*a*) and 5(*b*), using AG bond ply slightly reduces the effective dielectric constant and the propagation loss of the microstrips. To maintain the same resonant frequency, the pitch between slots, $p_s$, is increased to 0.37 mm, and the length and width of the loop are slightly increased to 1.35 and 0.745 mm, respectively. The unloaded Q-factor and the averaged radiation loss of the loop resonator in the hybrid substrates are similar to their counterparts in the LCP substrates. The AG bond ply slightly increases the microstrip's impedance from 62 to 67Ω, which is preferable to suppress the dispersion of the loop resonator. The coupling efficiency of the slot-coupled double-sided microstrips is reduced slightly when a hybrid substrate is used, which may be due to that AG bond ply with low dielectric constant (2.8) and large thickness (66 μm) reduces $C_{21}$ and $C_{22}$. The simulated S-parameters of the directional couplers in the hybrid substrates are shown in FIGS. 3(*c*) and 3(*d*). The insertion loss, $S_{41}$, is −8.2 dB at Port 4, and the isolation, $S_{31}$, is better than −30 dB at Port 3 at around 95 GHz. The coupling efficiency is 0.7 dB lower than that in the LCP substrates at 95 GHz, which may slightly increase the loss of DFs in hybrid substrates. The HFSS models of the DFs are modified and re-simulated with an AG bond ply as a reference for the measured data.

B. Measurement Setup

In the measurement setup, we utilized ground-single-ground (G-S-G) probes on the probe stations, which are integrated with Agilent programmable network analyzer E8361C and mm-wave head controller N5260A. The G-S-G probe has a characteristic impedance of 50Ω and a pitch of 100 μm between signal and ground electrodes. Before measurement, the probes were calibrated with on-chip SOLT method by using CS-5 calibration substrate from GGB Industries Inc.

1) Vialess CBCPW Probe Pads:

To probe the DFs, conductor backed coplanar waveguide (CBCPW) vialess probe pads were utilized to connect the terminating conductive strips of the microstrips. These probe pads achieve low loss and low reflection at high frequencies. The insertion loss of a pair of probe pads is less than 1.4 dB at W-band, i.e., 75-110 GHz.

2) W-Band Load:

To characterize the proposed four-port structures, two ports are probed, while the remaining two ports should be terminated with perfect loads. However, the commercially available state-of-the-art 50-Ω resistors only function up to 50 GHz. Beyond 50 GHz, these resistors become inductive, thus cannot serve as perfect loads. To improve the load performance, we attached RF absorbers onto the conductive strips of the microstrips to attenuate the reflection. The CBCPW probe pad terminated conductive strips of the microstrips were integrated with 50-Ω resistors and high-loss RF absorbers to investigate the reflection. The resistors are S0402AF from State of the Art Inc., and the absorber material is C-RAM GDSS from Cuming Microwave Corp. With only the resistor load, the reflection is as strong as −4 dB at W-band, i.e., 75-110 GHz. With a 10-mm-long absorber, the reflection is less than −14 dB. With both absorber and resistor, the reflection can be suppressed down to less than −17 dB at W-band, i.e., 75-110 GHz.

C. Measured S-Parameters

Figure 7:
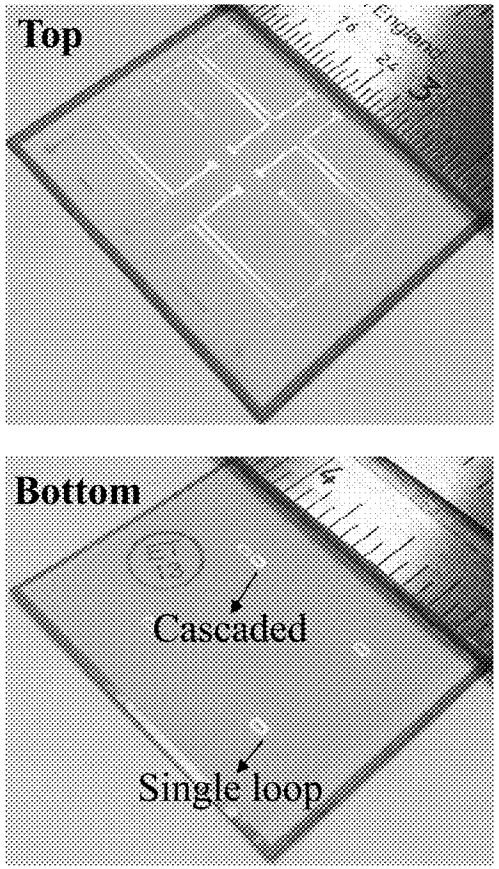
FIG. 7 shows pictures of the fabricated directional filters according to an embodiment of the present disclosure.
Figure 7:
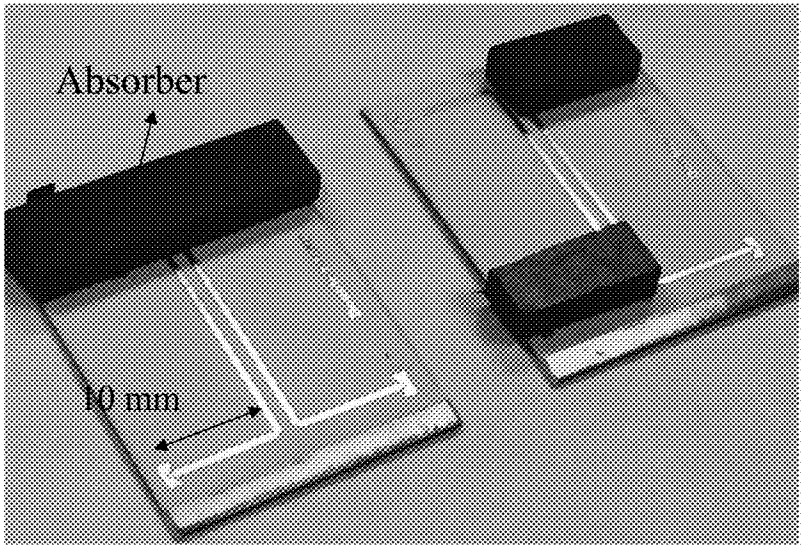

The fabricated single-loop and cascaded DFs are shown in FIG. 7. The material properties utilized in HFSS simulation and the dimensions of the HFSS modules and fabricated devices are listed in Table I, revealing a small fabrication tolerance. During the measurement, different ports of the DFs were terminated properly to characterize the corresponding S-parameters. To simplify the load switch for the two terminated ports, we utilized 10-mm-long RF absorbers to attenuate the reflection. The reflection from these two terminated ports is approximately −16 dB at 95 GHz, which will slightly affect the measured S-parameters of the proposed DFs. In the practical application, both resistors and absorbers may be beneficial to eliminate the reflection.

Figure 8:
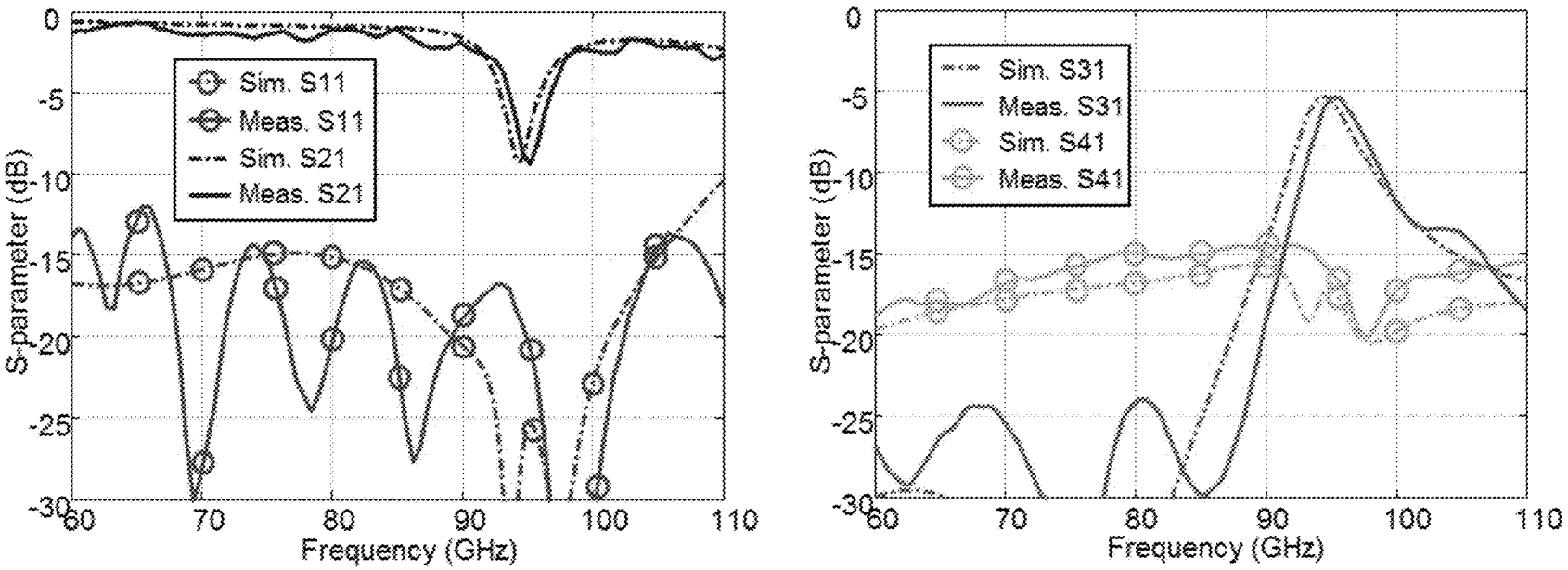
FIG. 8 illustrates a simulated result and a measured result of characteristics of a directional filter according to an embodiment of the present disclosure.

1) Single-Loop DFs:

The simulated and measured S-parameters of the asymmetric single-loop DF in hybrid substrates are shown in FIG. 8, showing good agreement. The measured insertion loss of the passband is 5.2 dB at 95 GHz, and the 3-dB bandwidth is 4.8% centered at 95 GHz. The isolation is better than −17 dB, and the reflection is lower than −16 dB at 95 GHz. The through signal, $S_{21}$, is approximately −9 dB at 95 GHz, which is limited by the coupling efficiency of the directional coupler. The measured out-of-band rejection of the passband is slightly higher than the simulation, which may be attributed to the reflection from the terminated ports attached with RF absorbers.

Figure 9:
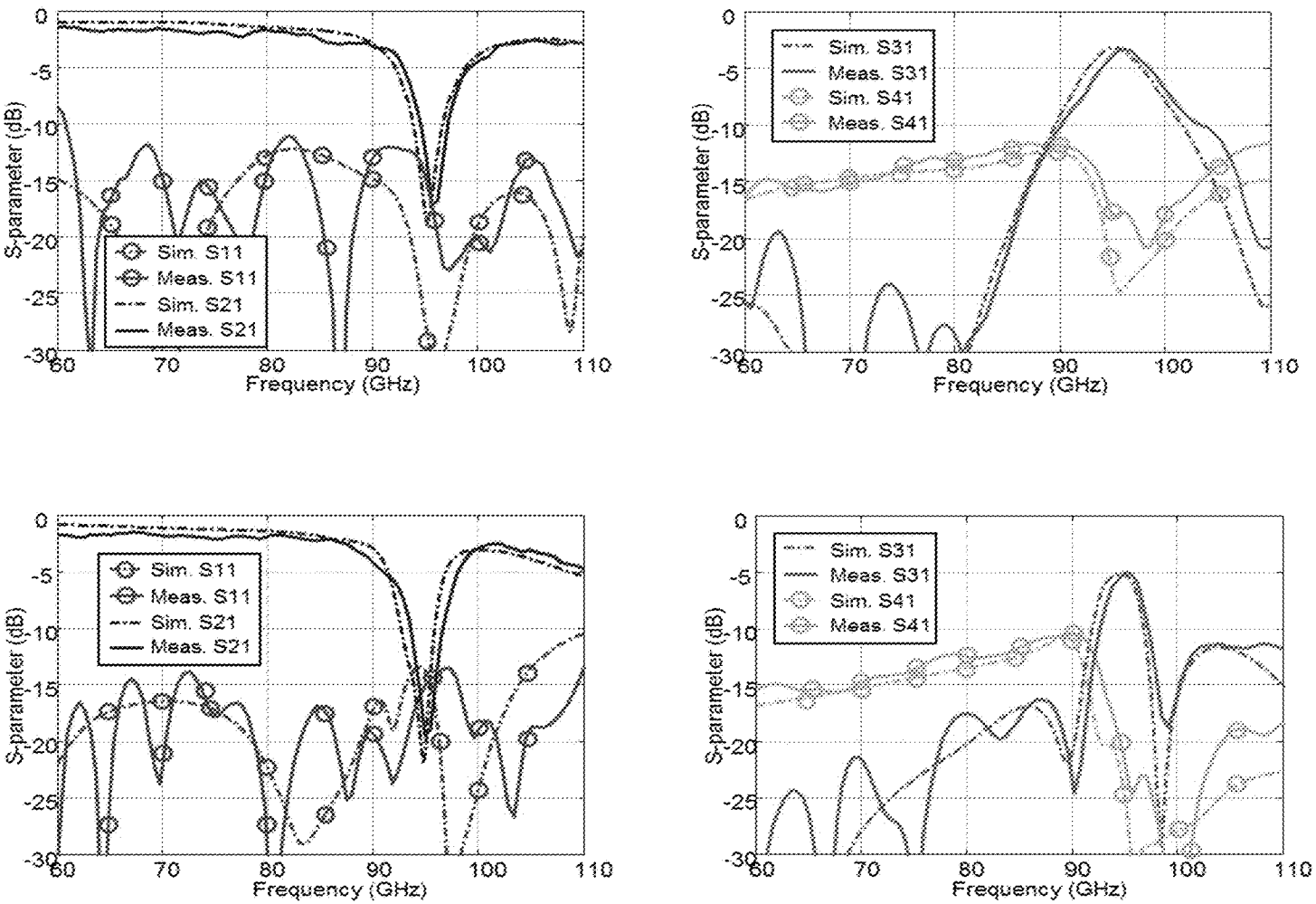
FIG. 9 shows characteristics of directional filters according to an embodiment of the present disclosure.

2) Cascaded Double-Loop DFs:

The simulated and measured S-parameters of the cascaded DFs in hybrid substrates are shown in FIG. 9. By cascading two DFs, the insertion loss ($S_{31}$), isolation ($S_{41}$), and through loss ($S_{21}$) can be improved significantly with a cost of slightly increased bandwidth and reflection. At $P_d$=1.9 mm, the corresponding phase delay θ between two DFs is 2π. The measured insertion loss of the passband is 3.16 dB at 96 GHz, and the 3-dB passband width is increased to 7.8% centered at 96 GHz. The through signal is reduced to −18 dB at the center frequency. At $P_d$=2.3 mm, the corresponding phase delay θ between two DFs becomes 5π/2. The measured insertion loss is increased to 5.4 dB at 95.5 GHz due to the destructive phase delay between the DFs. Two transmission zero points can be introduced to achieve a narrow bandwidth of 4% centered at 95.5 GHz. The measured reflection $S_{11}$ and isolation $S_{41}$ of these two cascaded double-loop DFs are below −12 and −10 dB, respectively.

The center frequency of the measured data is slightly higher than that of the simulated ones, which can be attributed to the over-etching. The over-etching slightly reduces the loop length as well as the width of the conductive strips, which slightly reduces the effective dielectric constant. The insertion losses of the DFs in the hybrid substrates are approximately 0.7 dB lower than their counterparts in the LCP substrates, which is due to the AG bond ply with low dielectric constant and large thickness. Cascading two DFs can reduce the insertion loss by a factor of 2 dB. The insertion loss, bandwidth, and out-of-band rejection of the single-loop and double-loop DFs in the LCP substrates and hybrid substrates are listed in Table II.

Embodiments of the present disclosure provide slot-coupled traveling-wave DFs in multilayer LCP substrates, and in hybrid substrates. A single-loop DF consists of two dual-slot quarter-wavelength directional couplers and one loop resonator with a circumference of two wavelengths at 95 GHz. To improve the directivity, asymmetric loop is carefully designed. The passband insertion loss and the bandwidth of the single-loop DF in the LCP substrates are approximately 4.6 dB at 94 GHz and 4.9% centered at 94 GHz, respectively. To improve the directivity and reduce the insertion loss, two DFs can be cascaded in series. An insertion loss of 2.6 dB can be achieved for the cascaded DFs in the LCP substrates. Limited by the practical application, AG bond ply is utilized to substitute the LCP bond ply, slightly reducing the coupling efficiency of the coupler and increasing the insertion loss of the DFs. The simulated and measured insertion loss of the single-loop and double-loop DFs in the hybrid substrates is increased to 5.4 and 3.1 dB at 95 GHz, respectively. The proposed DFs may have many applications in the DFM.

By using asymmetric phase topology for the loop resonator, the proposed DFs address higher directivity and Q-factor over the symmetric traveling-wave DFs. The single-loop DF was demonstrated with a 3-dB passband width of 4.8% and an insertion loss of 4.6 dB at 94 GHz. To improve the directivity, particularly the insertion loss, two identical DFs were cascaded in series in the direction of the terminating lines. A bandwidth of 8% and a low insertion loss of 2.6 dB can be obtained with a phase delay of 360° between the two DFs. Limited by the practical application, the proposed DFs were fabricated and demonstrated in hybrid substrates, which slightly increases the insertion loss. The measured insertion loss of the single-loop and double-loop DFs is 5.2 and 3.1 dB at 95 GHz, respectively, showing good agreement with the simulated data.

Herein below, a method of operating a directional filter according to an embodiment of the disclosure is described with reference to FIGS. 4(*a*)-4(*c*) and 6(*a*)-6(*b*). However, present embodiment is not limited to these figures. For example, this operating method may be applied to any directional filter applicable to the method of present embodiment.

First, a electromagnetic wave signal such as one having a millimeter wavelength is be applied to an input port of a directional filter, e.g., port 1 of FIG. 4(*a*) or FIGS. 6(*a*) and 6(*b*). For example, the electromagnetic wave signal may be applied to the input port from an input circuit. The electromagnetic wave signal may have a W-band frequency or another frequency of millimeter wave. The electromagnetic wave signal may propagate along a first conductive strip (e.g., 12*a*) electrically connected to the input port. While the electromagnetic wave signal propagates along the first conductive strip, a first coupling signal may be generated in a first loop resonator (e.g., 12*c*). The first loop resonator may overlap the first conductive strip interposed with an insulation layer therebetween, e.g., an LCP layer. The first coupling signal may propagate along the first loop resonator. While the first coupling signal propagate along the first loop resonator, a second coupling signal may be generated in a second conductive strip overlapping the first loop resonator. An insulation layer may be interposed between the first loop resonator and the second conductive strip. The second coupling signal may propagate along the second conductive strip. The second coupling signal may be output from an output port of the second conductive strip. The second coupling signal may be output to a circuit utilizing the output signal. The first and second coupling signals may be generated through slots formed in a ground plane interposed between the loop resonator and the first and second conductive strips respectively. Portions of the coupling signals may constructively interfere, and some other portions of the coupling signals may destructively interfere depending on places of the slots and propagation directions. The output signal may be a resultant signal of the constructive interference and/or the destructive interference.

Above described operating method may further include one or more of the structural features and/or operational features of the previously described embodiments of the present disclosure. For example, the operating method may include a second loop resonator illustrated in FIGS. 6(*a*) and 6(*b*) and its operational element described with respect to FIGS. 6(*a*)-6(*d*).

While the disclosure has been shown and described with reference to example embodiments thereof, it will be understood that various changes in form and details may be made therein without departing from the spirit of the disclosure, and scope of the invention should be determined by the following claims.

What is claimed is:

1. A directional filter comprising:

a first conductor line extending in a first direction, the first conductor line comprising a first end and a second end;

a second conductor line spaced apart from the first conductor line, the second conductor line extending parallel to the first conductor line, the second conductor line comprising a third end and a fourth end;

a conductor plate comprising a first hole, a second hole, a third hole and a fourth hole spaced apart from one another; and a first conductor loop disposed opposite the first and second conductor lines with respect to the conductor plate, wherein the first end is configured to receive an electro-magnetic signal, wherein the second end is configured to transmit the received electro-magnetic signal, wherein the first conductor loop is configured to receive a first coupling signal of the electro-magnetic signal received by the first end, and wherein the third end is configured to receive a second coupling signal of the first coupling signal.

2. The directional filter of claim 1, further comprising:

a first insulation layer formed between the first and second conductor lines and the conductor plate, the first insulation layer configured to insulate the first and second conductor lines from the conductor plate; and a second insulation layer formed between the first conductor loop and the conductor plate, the second insulation layer is configured to insulate the first conductor loop from the conductor plate.

3. The directional filter of claim 2, wherein the first and second insulation layers comprise a liquid crystal polymer.

4. The directional filter of claim 2, wherein the fourth end is configured to be isolated from the electro-magnetic signal applied to the first end.

5. The directional filter of claim 1, wherein the second coupling signal received at the third end has a first wavelength, and a circumferential distance of the first conductor loop is an integer multiple of the first wavelength.

6. The directional filter of claim 1, wherein the mean circumference of the first conductor loop is two times of a wavelength of a microwave having a frequency between 30 GHz and 300 GHz.

7. The directional filter of claim 1, wherein the mean circumference of the first conductor loop is about two times of a wavelength of a microwave having 95 GHz frequency.

8. The directional filter of claim 1, wherein the first and second holes overlap with the first conductor line in a plan view, and the third and fourth holes overlap with the second conductor line in a plan view, wherein the first conductor loop overlaps with the first, second, third and fourth holes in a plan view, wherein the first, second, third and fourth holes are symmetrically arranged around the center of the first conductor loop.

9. The directional filter of claim 1, wherein the first and second holes overlap with the first conductor line in a plan view, and the third and fourth holes overlap with the second conductor line in a plan view, wherein the first conductor loop overlaps with the first, second, third and fourth holes in a plan view, wherein the circumferential lengths of the first conductor loop on both sides, in a plan view, with respect to a line connecting the second hole and the fourth hole are substantially the same.

10. The directional filter of claim 1, further comprising:

a fifth hole, a sixth hole, a seventh hole and an eighth hole formed in the conductor plate, the fifth to eighth holes being spaced apart from one another; and a second conductor loop disposed opposite the first and second conductor lines with respect to the conductor plate, the second conductor loop being spaced apart from the first conductor loop, wherein the fifth and sixth holes overlap with the first conductor line in a plan view, and the seventh and eighth holes overlap with the second conductor line in a plan view, wherein the second conductor loop overlaps with the fifth, sixth, seventh and eighth holes in a plan view.

11. The directional filter of claim 10, wherein the circumferential lengths of the second conductor loop on both sides, in a plan view, with respect to a line connecting the sixth hole and the eighth hole are substantially the same.

12. A directional filter comprising:

a first microstrip comprising a first port and a second port;

a second microstrip disposed parallel to the first microstrip, the second microstrip comprising a third port and a fourth port;

a ground plate shared by the first and second microstrips and configured to have a reference signal applied thereto, the ground plate comprising a first slot, a second slot, a third slot and a fourth slot; and a first loop resonator disposed adjacent to the ground plate, wherein the first port is configured to receive an electro-magnetic signal, wherein the second port is configured to transmit the electro-magnetic signal, wherein the first loop resonator is configured to receive a first coupling signal of the electro-magnetic signal applied to the first port, and wherein the third port is configured to receive a second coupling signal of the first coupling signal.

13. The directional filter of claim 12, further comprising:

a first insulation layer formed on the ground plate, the first insulation layer configured to insulate the first to fourth ports from the ground plate; and a second insulation layer formed between the first loop resonator and the ground plate, the second insulation layer is configured to insulate the first loop resonator from the ground plate.

14. The directional filter of claim 13, wherein the first and second insulation layers comprise a liquid crystal polymer.

15. The directional filter of claim 13, wherein the fourth port is configured to be isolated from the electro-magnetic signal applied to the first port.

16. The directional filter of claim 12, wherein second coupling signal received at the third port has a first wavelength, and a circumferential distance of the first loop resonator is an integer multiple of the first wavelength.

17. The directional filter of claim 12, wherein the mean circumference of the first loop resonator is two times of a wavelength of a microwave having a frequency between 30 GHz and 300 GHz.

18. The directional filter of claim 12, wherein the mean circumference of the first loop resonator is about two times of a wavelength of a W-band microwave having a frequency between 75 and 110 GHz.

19. The directional filter of claim 12, wherein the first and second slots overlap with a first conductive strip of the first microstrip in a plan view, and the third and fourth slots overlap with a second conductive strip of the second microstrip in a plan view, wherein the first loop resonator overlaps with the first, second, third and fourth slots in a plan view, wherein the circumferential lengths of the first loop resonator on both sides, in a plan view, with respect to a line connecting a first center between the first and second slots and a second center between the third and fourth slots are substantially the same.

20. The directional filter of claim 12, wherein the first and second slots overlap with a first conductive strip of the first microstrip in a plan view, and the third and fourth slots overlap with a second conductive strip or the second microstrip in a plan view, wherein the first loop resonator overlaps with the first, second, third and fourth slots in a plan view, wherein the circumferential lengths of the first loop resonator on both sides, in a plan view, with respect to a line connecting the second slot and the fourth slot are substantially the same.

21. The directional filter of claim 12, further comprising:

a fifth slot, a sixth slot, a seventh slot and an eighth slot formed in the ground plate; and a second loop resonator disposed adjacent to the ground plate, wherein the fifth and sixth slots overlap with a first conductive strip or the first microstrip in a plan view, and the seventh and eighth slots overlap with a second conductive strip of the second microstrip in a plan view, wherein the second loop resonator overlaps with the fifth, sixth, seventh and eighth slots in a plan view.

22. The directional filter of claim 21, wherein the mean circumference of the second loop resonator on both sides, in a plan view, with respect to a line connecting the sixth slot and the eighth slot are substantially the same.

23. A directional coupler comprising:

a first conductor line extending in a first direction, the first conductor line comprising a first end and a second end;

a second conductor line spaced apart from the first conductor line, the second conductor line extending parallel to the first conductor line, the second conductor line comprising a third end and a fourth end; and a conductor plate comprising a first hole and a second hole spaced apart from each other, the conductor plate disposed between the first conductor line and the second conductor line, wherein the first end is configured to be applied with an electro-magnetic signal, wherein the second end is configured to be transmitted with the electro-magnetic signal, and wherein the fourth end is configured to receive a first coupling signal of the electro-magnetic signal applied to the first end, wherein widths of the first and second conductor lines are less than a quarter of the operating wavelength of the directional coupler, wherein the conductor plate is a ground plate applied with a ground signal, wherein the first and second holes penetrate through the ground plate, and wherein the first and second holes are filled with insulation material.

24. The directional coupler of claim 23, further comprising:

a first insulation layer formed between the first conductor line and the conductor plate, the first insulation layer configured to insulate the first conductor line from the conductor plate; and a second insulation layer formed between the second conductor line and the conductor plate, the second insulation layer is configured to insulate the second conductor line from the conductor plate.

25. The directional coupler of claim 24, wherein the third end is configured to be isolated from the electro-magnetic signal applied to the first end.

26. The directional coupler of claim 23, wherein the distance between the first hole and the second hole is a quarter of a wavelength of a microwave having a frequency between 30 GHz and 300 GHz.

27. The directional coupler of claim 23, wherein the distance between the first hole and the second hole is about a quarter of a wavelength of a microwave having 95 GHz frequency.

28. The directional coupler of claim 23, wherein the first and second holes overlap with the first and second conductor lines in a plan view.

29. The directional coupler of claim 23, wherein the first coupling signal received at the fourth end has a wavelength of four times of a distance between the first hole and the second hole.

30. A directional coupler comprising:

a first conductor line extending in a first direction, the first conductor line comprising a first end and a second end;

a second conductor line spaced apart from the first conductor line, the second conductor line extending parallel to the first conductor line, the second conductor line comprising a third end and a fourth end;

a conductor plate comprising a first hole and a second hole spaced apart from each other, the conductor plate disposed between the first conductor line and the second conductor line;

a first insulation layer formed between the first conductor line and the conductor plate, the first insulation layer configured to insulate the first conductor line from the conductor plate; and a second insulation layer formed between the second conductor line and the conductor plate, the second insulation layer is configured to insulate the second conductor line from the conductor plate, wherein the first end is configured to be applied with an electro-magnetic signal, wherein the second end is configured to be transmitted with the electro-magnetic signal, wherein the fourth end is configured to receive a first coupling signal of the electro-magnetic signal applied to the first end, and wherein the first and second insulation layers comprise a liquid crystal polymer.

31. The directional coupler of claim 30, wherein widths of the first and second conductor lines are less than a quarter of the operating wavelength of the directional coupler, wherein the conductor plate is a ground plate applied with a ground signal, wherein the first and second holes penetrate through the ground plate, and wherein the first and second holes are filled with insulation material.

* * * * *